US005682144A

United States Patent [19]

Mannik

[11] Patent Number: 5,682,144

[45] Date of Patent: Oct. 28, 1997

[54] EYE ACTUATED SLEEP PREVENTION DEVICES AND OTHER EYE CONTROLLED DEVICES

[76] Inventor: Kallis Hans Mannik, K.H. Mannik P.O. Box 43, Webster, N.Y. 14580

[21] Appl. No.: 559,652

[22] Filed: Nov. 20, 1995

[51] Int. Cl.[6] ..... G08B 23/00

[52] U.S. Cl. ..... 340/575; 340/576; 340/825.19; 128/745; 250/221

[58] Field of Search ..... 340/575, 576, 340/825.19; 351/210; 250/221; 128/745; 180/272; 364/569

[56] References Cited

U.S. PATENT DOCUMENTS

| | | | |
|---|---|---|---|
| 3,781,802 | 12/1973 | Kafafian | 340/825.19 |
| 3,798,599 | 3/1974 | Kafafian | 340/825.19 |
| 3,953,831 | 4/1976 | Estrada | 340/575 |
| 4,081,623 | 3/1978 | Vogeley | 379/354 |
| 4,144,531 | 3/1979 | Anbergen | 340/575 |
| 4,196,412 | 4/1980 | Sluis et al. | 340/575 |
| 4,397,531 | 8/1983 | Lees | 340/575 |
| 4,875,030 | 10/1989 | Chiu | 340/575 |
| 4,953,111 | 8/1990 | Yamamoto et al. | 364/569 |
| 4,967,186 | 10/1990 | Ludmirsky et al. | 340/575 |
| 5,057,834 | 10/1991 | Nordstrom | 340/963 |
| 5,360,971 | 11/1994 | Kaufman et al. | 250/221 |
| 5,402,109 | 3/1995 | Mannik | 340/575 |

*Primary Examiner*—Jeffery Hofsass
*Assistant Examiner*—Benjamin C. Lee

[57] ABSTRACT

This invention is an eyeglass attachable device for automobile and truck drivers for an alertness alarm signal and for related applications, like controlling the steering wheel movements of a vehicle, a car, a truck or a motorized wheelchair, by means of blinking of the the eyes.

This eyeglass attachable alarm signal device prevents automobile and truck drivers from falling asleep, while driving. A beam of a narrow band infrared light or a beam of ultrasound is used for sensing, whether the driver's eyelids are closed or are in an open position. A tiny adjustable infrared light emitter carrier, sliding along one of the eyeglasses temples is used for positioning the light emitter on the eyeglasses temple properly for each driver. This positioning can be done also automatically, by means of using a servomotor or electronically, by selecting and switching on continuously just the right beam, which is passing in close proximity of the eyeball.

18 Claims, 27 Drawing Sheets

EYE ACTUATED SLEEP PREVENTION DEVICES AND OTHER EYE CONTROLLED DEVICES

BRIEF SUMMARY OF THE INVENTION

This invention is an eyeglass attachable device for automobile and truck drivers for an alertness alarm signal and usable also for various additional applications, like controlling the steering wheel movements of a vehicle, a car, a truck or a motorized wheelchair, by means of blinking the the eyes.

This eyeglass attachable alarm signal device prevents automobile and truck drivers from falling asleep, while driving. A beam of a narrow band infrared light or a beam of ultrasound is used for sensing, whether the driver's eyelids are closed or are in an open position.

A tiny adjustable infrared light emitter carrier, sliding along one of the eyeglasses temples, is used for positioning the light emitter on the eyeglasses temple just right for each driver.

For alerting a drowsy driver, whose eyes have been closed for a longer time period than about one second, an electronic circuitry is activated by means of the closed eye signal from the two parallel-coupled infrared light detectors, turning on an alarm signal from a buzzer or similar, after an one second or shorter time delay.

Electronically finding out the right infrared light beam, which is closest passing the eyeball, is done by means of analyzing the eye-wetting blinks presence in a number of infrared light beams. A normal eye-wetting blink of the eye don't trigger the alarm signal.

BRIEF DESCRIPTION OF THE DRAWINGS

FIG. 25 shows also, how the infrared light from the infrared emitters and from incandescent lamps, mounted in the ceiling, is beaming down onto the 4 solar cells mounted to the left temple of the driver's eyeglasses, for generating electricity for powering the electronic circuitry of this driver sleep-preventing device.

It shows also the solenoid controlled clamp around the cylinder-forming widened part of the steering wheel's shaft of the automobile and the two solenoids for turning the steering wheel of the car to the left, counter clockwise or to the right, clockwise.

Figure 33:
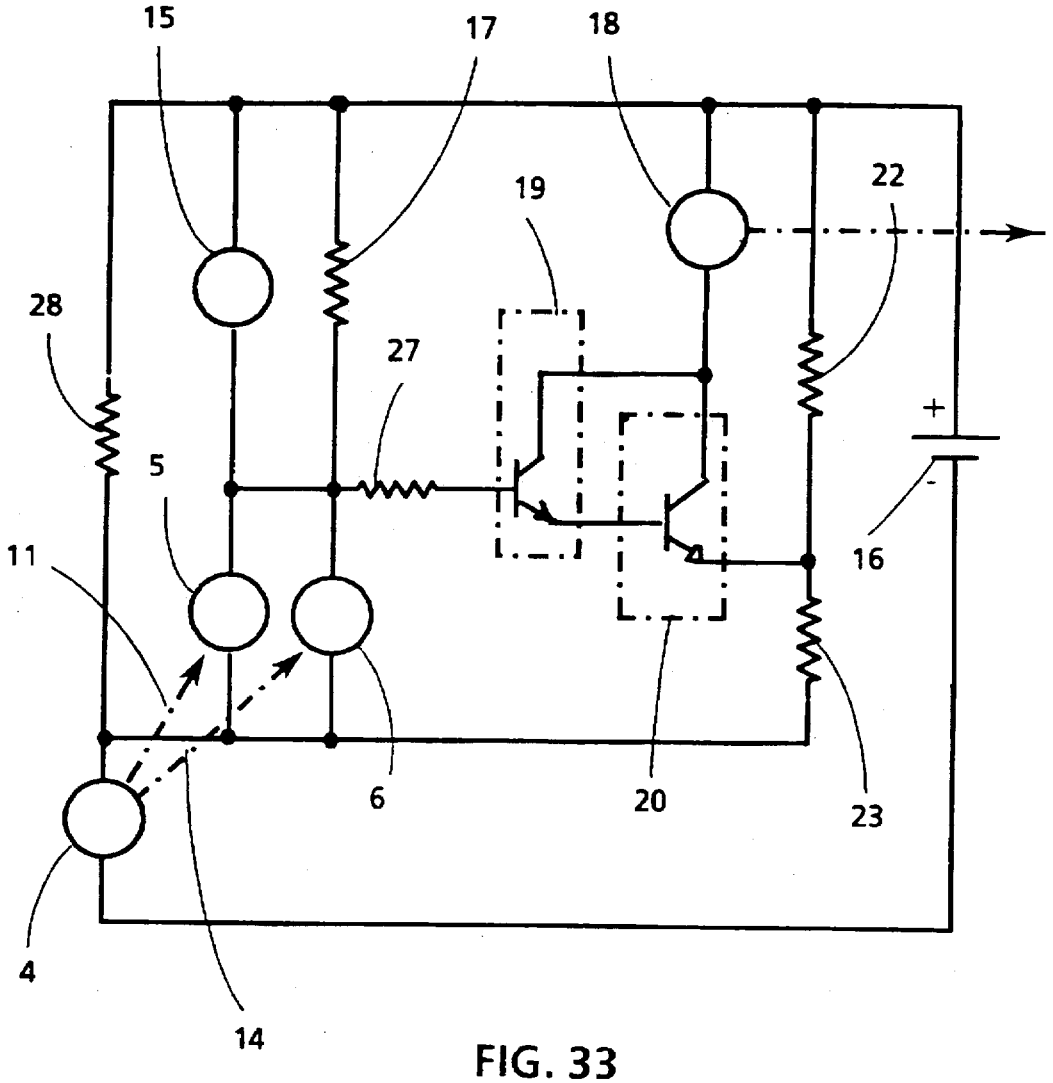

FIG. 33 shows the electronic circuitry according to the present invention without delay feature for application as a toy and for controlling device for turning on and off electric lights or electric appliances or for controlling the movements of a wheelchair.

Figure 34:
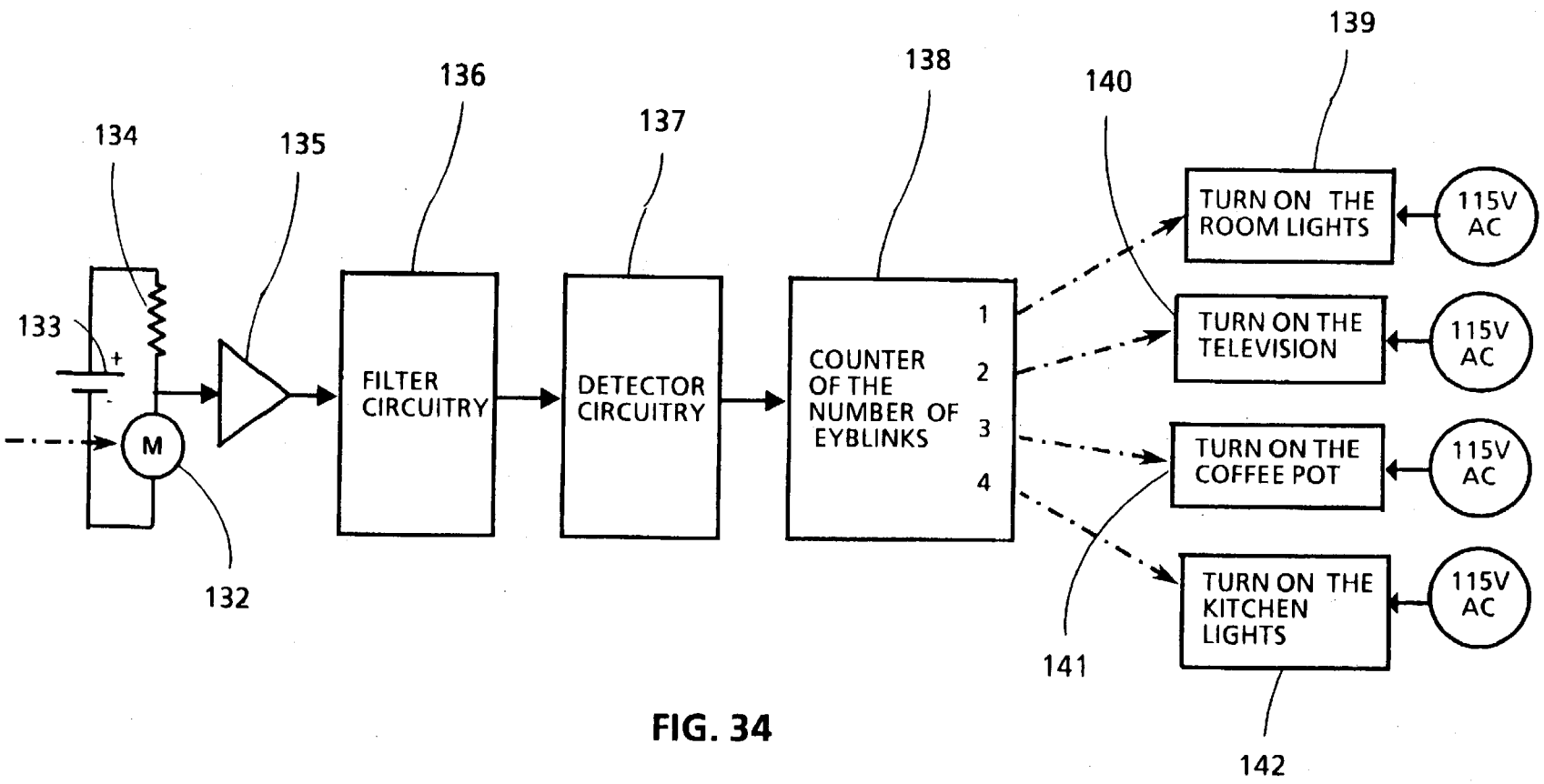

FIG. 34 shows the controlling device for turning on and off appliances and electric lights.

Figure 35:
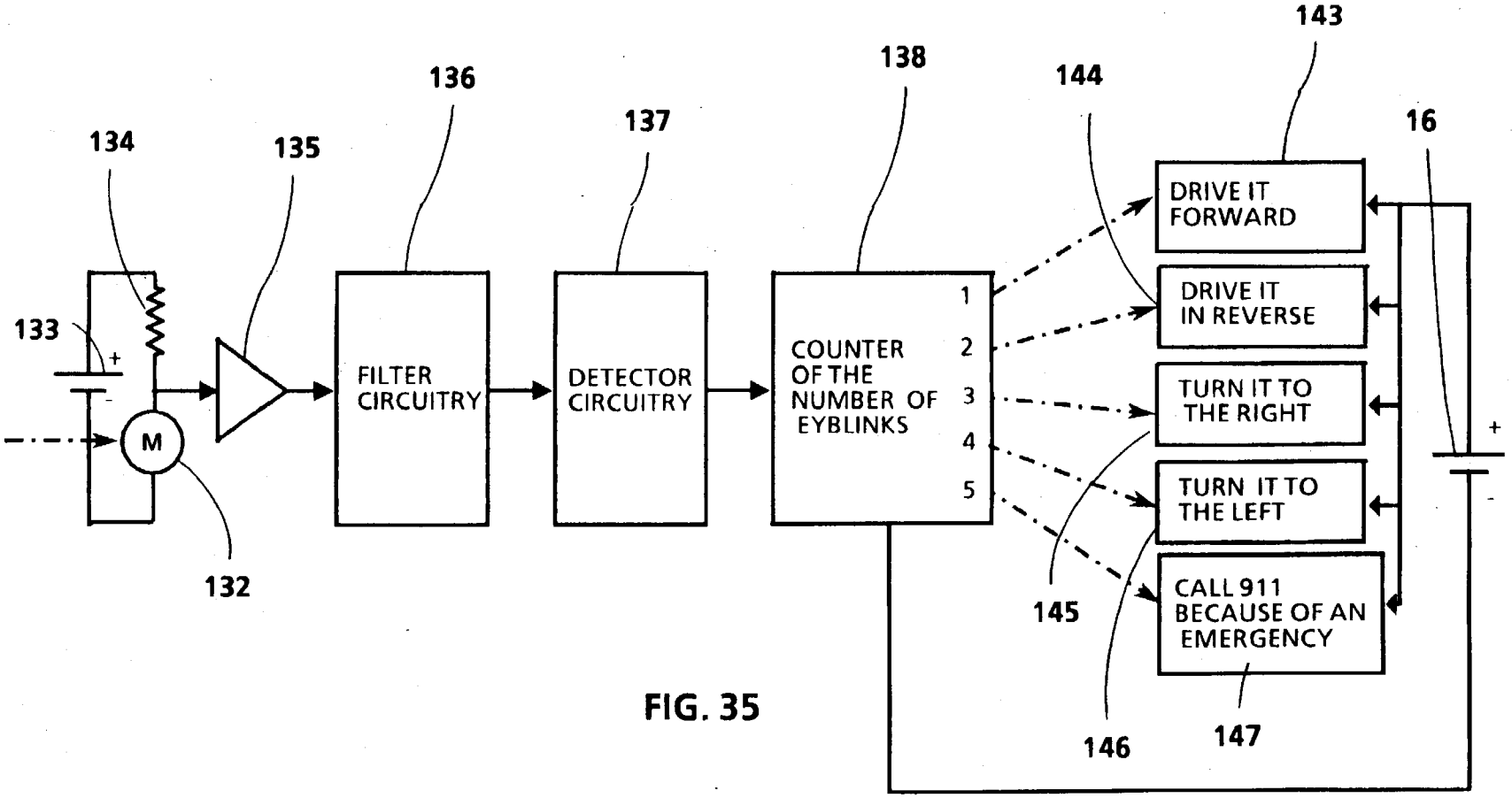

FIG. 35 shows the controlling device for operating a wheelchair according to the present invention.

Figure 36:
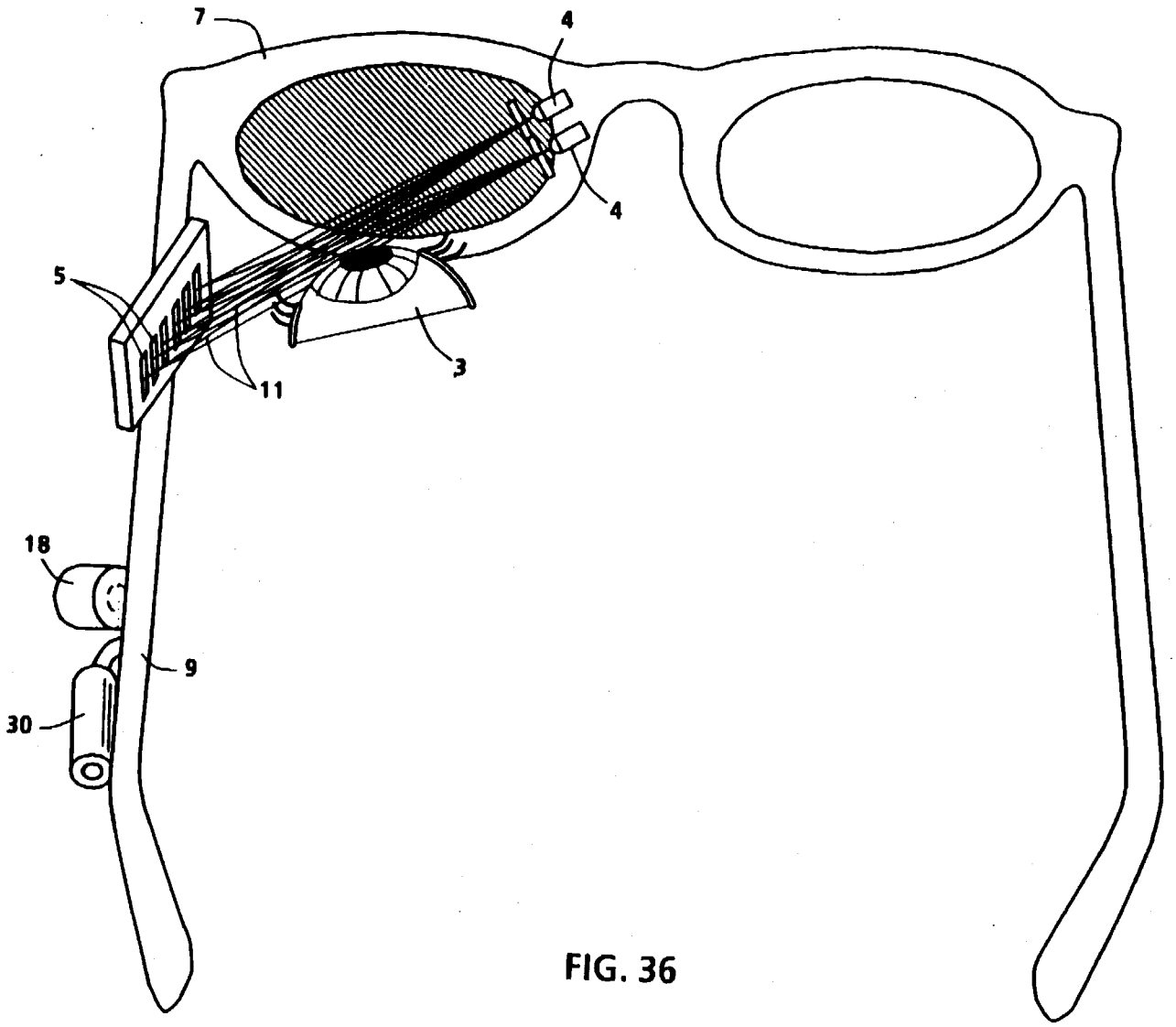

FIG. 36 shows eyeglasses according to the present invention, where the undesired effect of sliding down of eyeglasses along the nose, is eliminated electronically.

Figure 37:
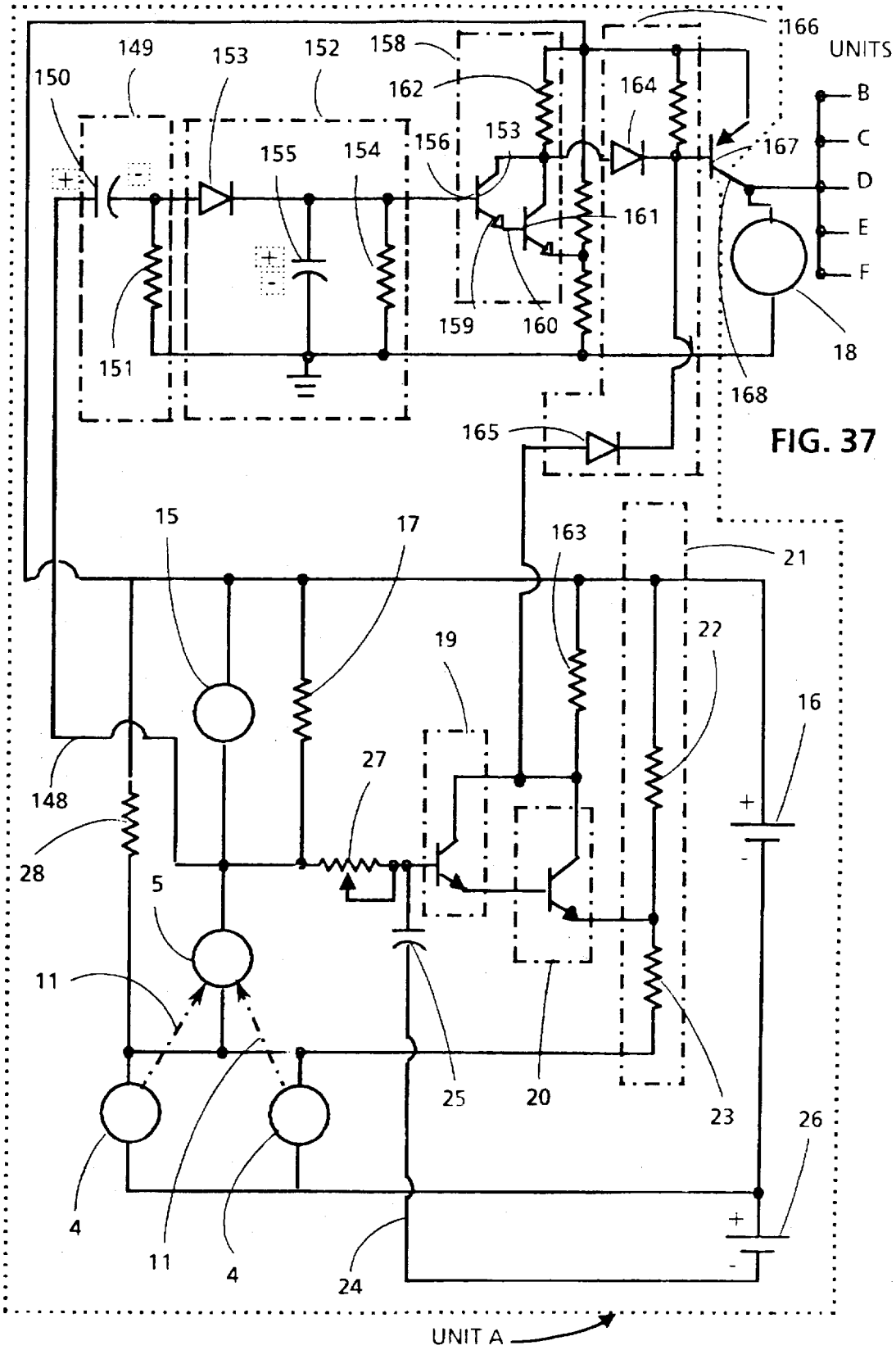

FIG. 37 shows the circuitry, which is used to correct for this sliding down effect electronically.

Figure 38:
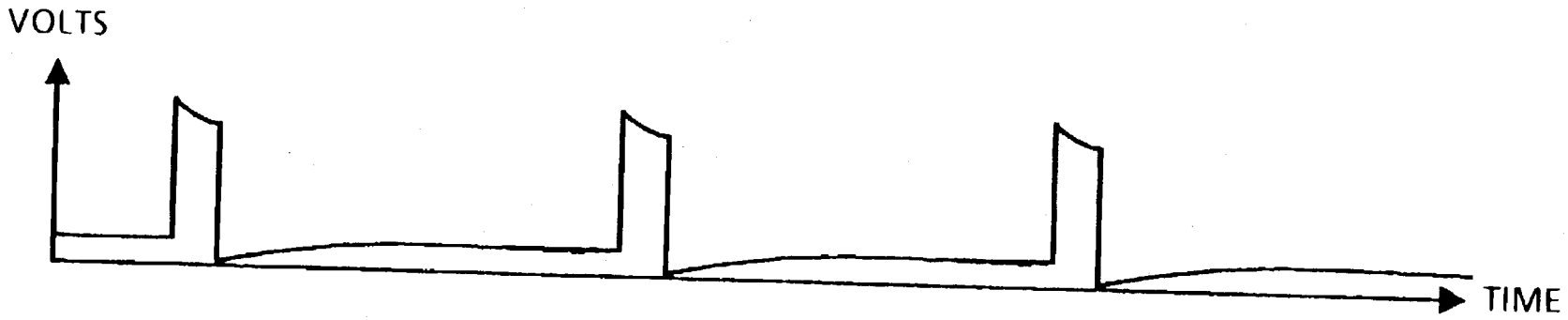

FIG. 38 shows the resulting pulse form from eye-wetting blinking signals, after these pulses have passed through a differentiating circuitry.

Figure 39:
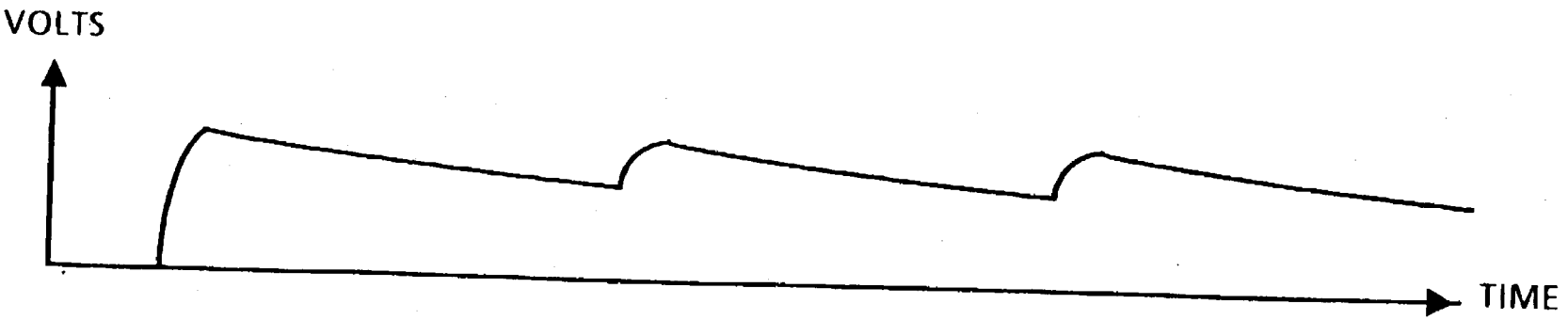

FIG. 39 shows the resulting pulse form of the eye-wetting blinking signal at the output of the detector circuitry.

Figure 40:
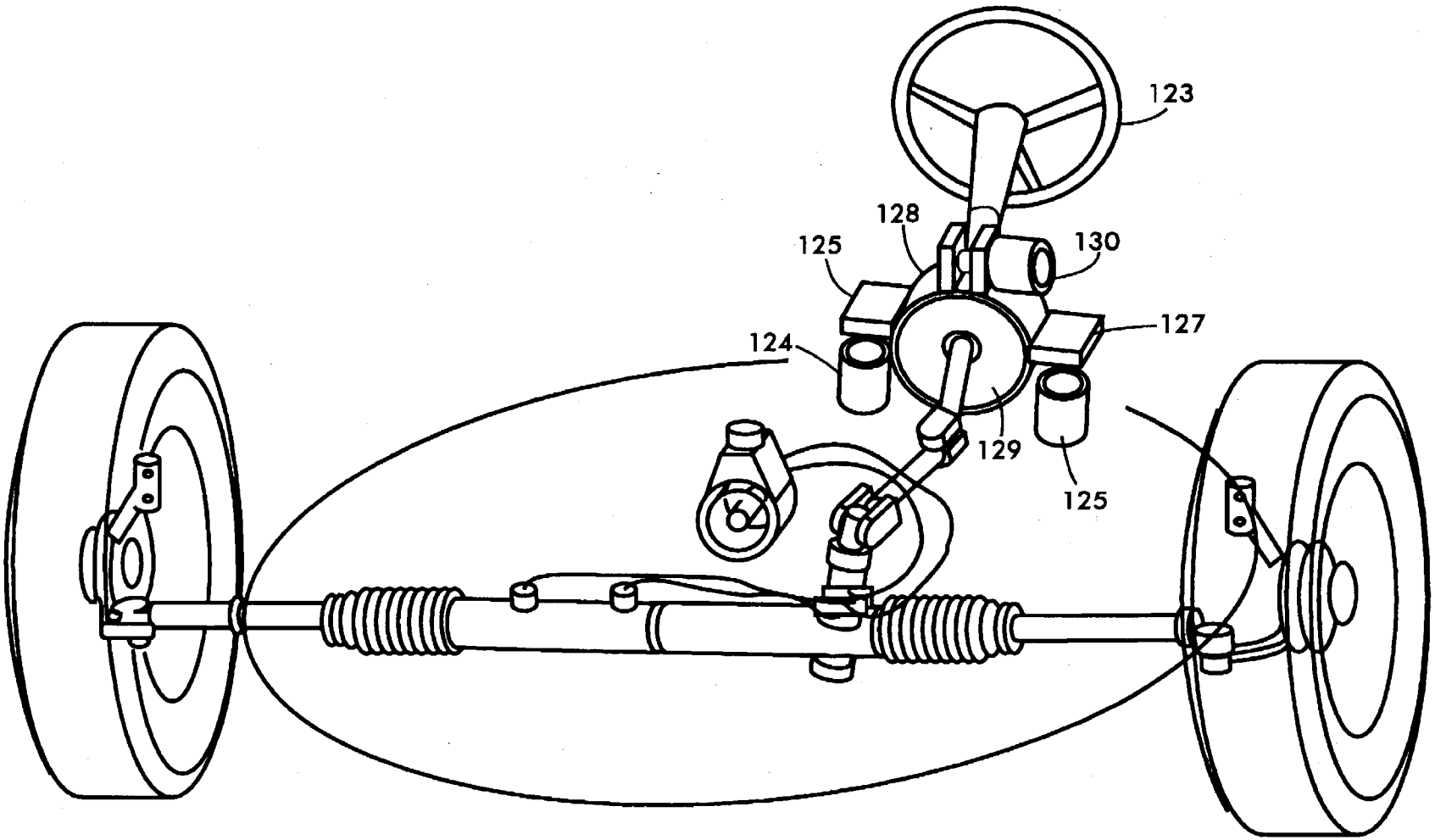

FIG. 40 shows the steering wheel rack and the steering wheel of a typical new automobile, with the steering wheel's cylindrical attachment according to my present invention.

It shows also the solenoid controlled clamp around the cylinder-forming widened part of the steering wheel's shaft of the automobile and the two other solenoids for turning the steering wheel of the car to the left, counter clockwise or to the right, clockwise.

DETAILED DESCRIPTION

This invention is an eyeglasses attachable alarm signal device for automobile and truck drivers, preventing them from falling asleep, while driving. This invention is also an eyeglasses attachable device for controlling the movements of a steering wheel of an automobile or wheelchair, by means of blinking of the eye.

This invention is also an eyeglass attachable controlling device for various electric appliances, electric lights, television, coffeemaker and similar equipment. In this invention it is used various beams together with beam emitting means, such as infrared light, narrow band colored light, high frequency ultrasonic sound, airflow, or similar means for sensing whether the driver's eyes are open or closed. This invention is a driver wake-up device designed both for daytime and for nighttime driving. A beam of infrared light or a beam of ultrasonic sound, is used for optical or acoustical sensing, whether the driver's eyelids 1 and 2. FIGS. 1, 2, 3, 5 and 6, are closed or whether they are open. FIGS. 1, 2, 3, 4 and 5 show eyes in the open position. FIG. 6 is showing the eye closed and eyelid 1, FIG. 6 covering the eyeball 3, FIG. 6.

Figure 1:
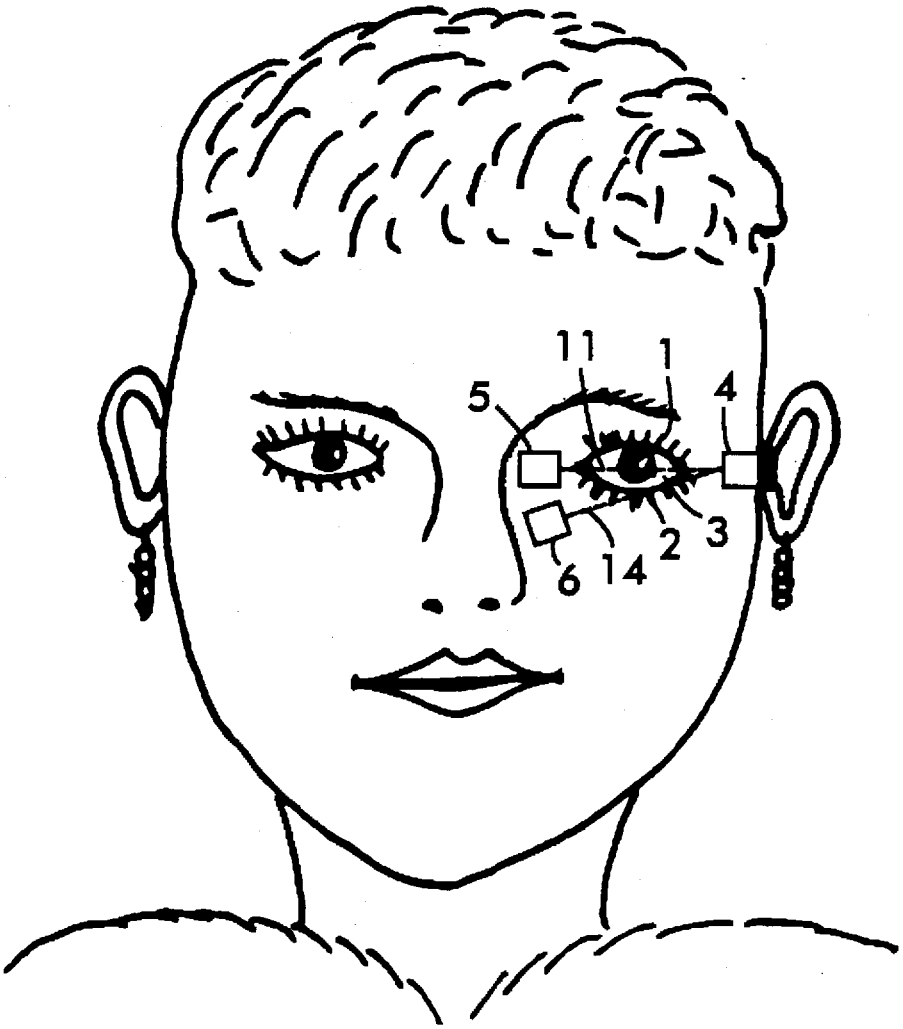
FIG. 1 shows the approximate positions of the infrared light emitter and the two infrared light detectors in relation to the driver's eye.
Figure 2:
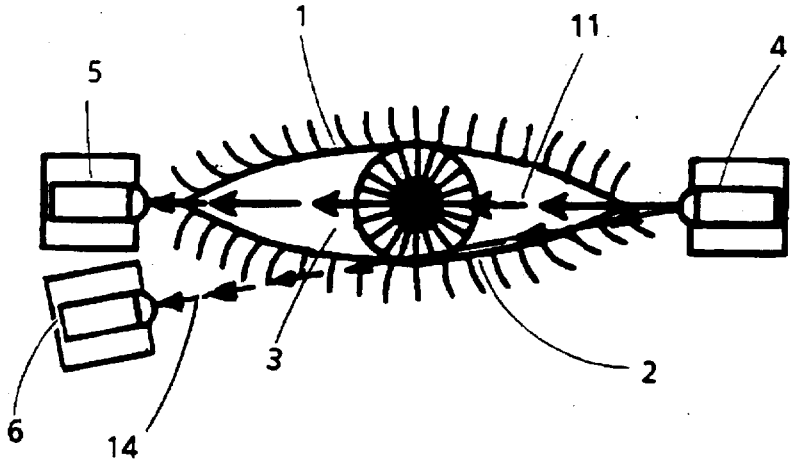
FIG. 2 is a view of the driver's eye and the positions of the infrared light emitter and of the two infrared light detectors and driver's eyelids, when the drivers eyes are open and the driver is looking forward, as he is doing, while driving.

FIGS. 1 and 2 show the driver's eye, the position of his upper eyelid 1, FIGS. 1 and 2 and the position of his lower eyelid 2, FIGS. 1 and 2, when the driver of the car is looking forward while driving his car.

Figure 3:
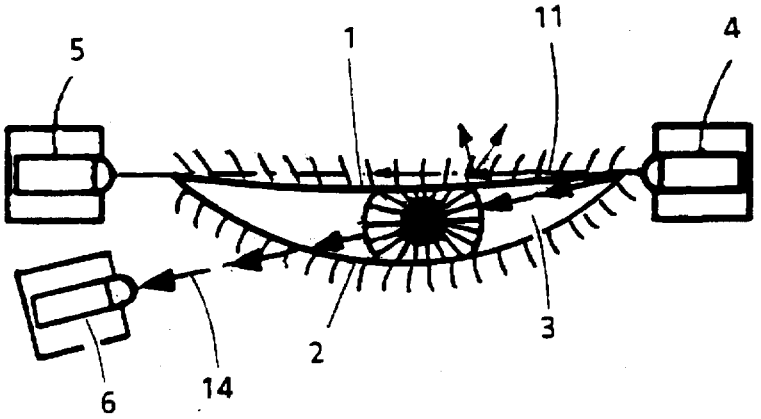
FIG. 3 is a view of the driver's eye and positions of the infrared light emitter, two infrared light detectors and the position of the driver's eyelids, when the driver is briefly looking downward while driving the car.

FIG. 3 shows the driver's eye, the position of his upper eyelid 1, FIG. 3 and the position of his lower eyelid 2, FIG. 3, when the driver of the car is looking downward.

Figure 7:
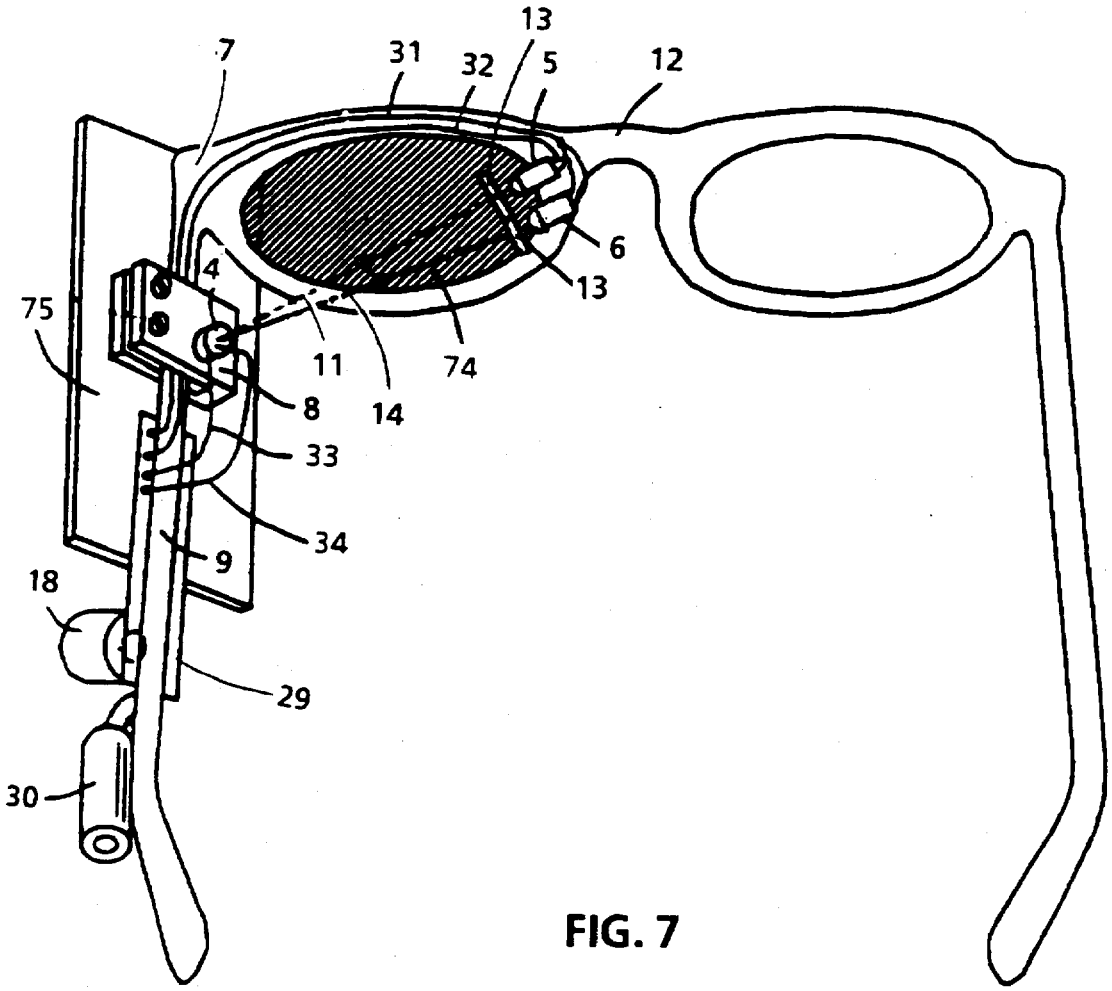
FIG. 7 is a perspective view of the sleep-preventing alarm device, in which it is used an infrared emitter and two infrared detectors, attached to a pair of regular eyeglasses, which have a heat-reflective coating on their surface and a shield behind the emitter-side of the eyeglasses, to prevent the bright daylight and the sunshine from interfering with operation of this device during daytime driving.

FIG. 7 shows how the emitter 4, FIG. 7, infrared light detectors 5 and 6 FIG. 7 and all the other components according to the present invention are mounted onto the eyeglasses frame 7, FIG. 7.

Figure 4:
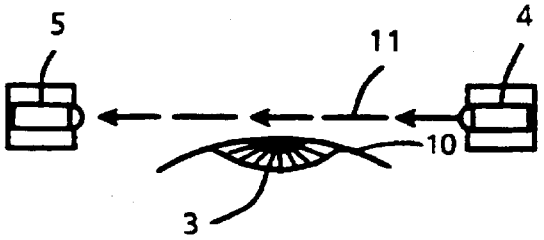
FIG. 4 is a cross section of the light emitter, one of the light detectors and of the drivers eye, when the driver's eyes are open.
Figure 5:
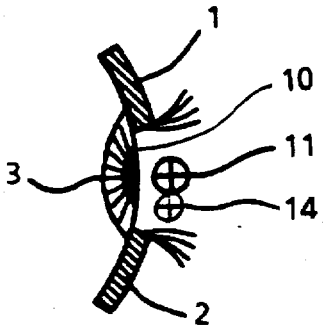
FIG. 5 is a vertical cross-sectional view of the driver's eye, showing the approximate position where both light beams 11 and 14 are passing the eye when the car driver's eyes are open.
Figure 6:
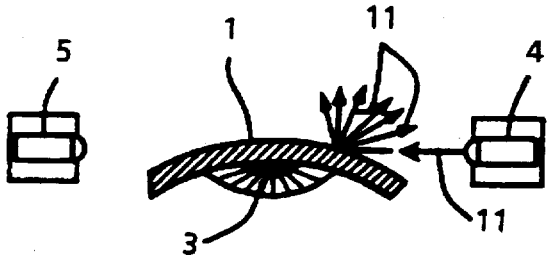
FIG. 6 is a horizontal cross-sectional view of the driver's eye, when the eyes of the driver are closed. This view shows how the upper eyelid prevents the light from the emitter reaching the light detector.

A slide-adjustable infrared emitter carrying block 8, FIG. 7, for the infrared light emitter 4, FIG. 7 which is sliding along the temple 9, FIG. 7, of the eyeglasses 7, FIG. 7 forth and back, is used to position the light emitter 4 on the eyeglasses temple 9 properly in relation to the eyeball's 3 surface 10, FIGS. 4 and 5. A light beam 11 from the emitter 4, FIG. 1, 2, 3, 4, 5, 6 and 7 is aimed across the surface 10 of the driver's eyeball 3, FIGS. 4 and 5, just above the eyeball 3, between the eyelids 1 and 2 to the infrared light detector 5, FIGS. 1, 2, 3, 4, 6 and 7 which is mounted in the opposite corner of the eye on the left lense of the eyeglasses 7 close to the bridge 12 of the eyeglasses 7, FIG. 7. This infrared light detector has an infrared light filter 13, FIG. 7, preferably the Kodak's Wratten filter #87 or #87C mounted in front of it. Another light beam 14, FIGS. 1, 2, 3, 5 and 7 from the emitter 4, which is aimed across the surface 10 FIGS. 4 and 5 of the drivers eyeball 3, is adjusted to hit a light detector 6, FIGS. 1, 2, 3 and 7 which is mounted on the side of the first light detector 5, FIGS. 1, 2, 3 and 7. This light detector 6, FIGS. 1, 2 3 and 7 receives infrared light from the emitter 4 every time when the driver looks downward, as shown in FIG. 3.

The audible alarm signal starts to sound only when the upper eyelid 1, FIGS. 1, 2, 3, 5 and 6 is closed and thus prevents the light from the emitter 4 to fall onto each of these light detectors, 5 and 6, FIGS. 1, 2, 3 and 7.

Figure 8:
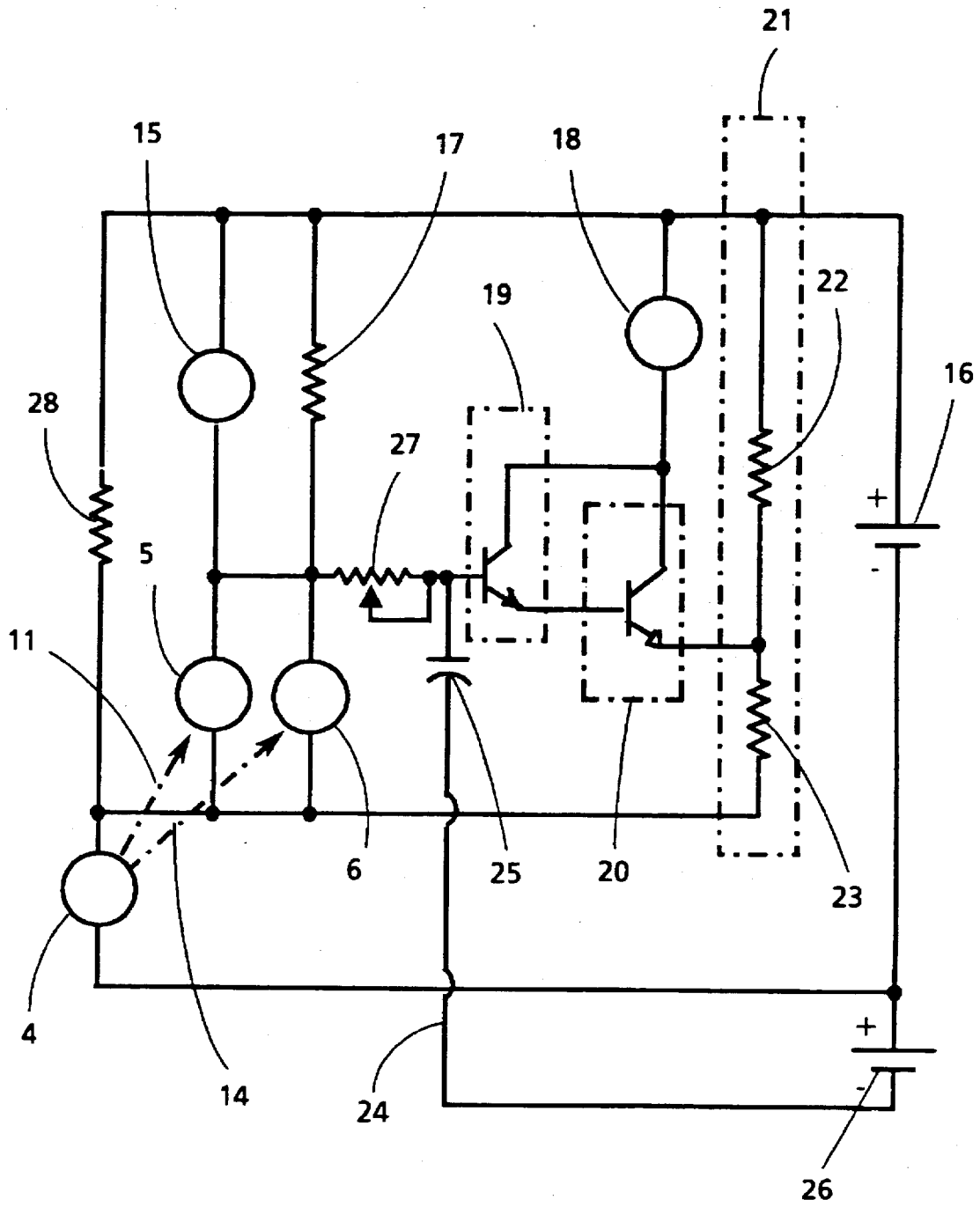
FIG. 8 shows the electronic circuitry for this sleep-preventing device, consisting of an infrared emitter, two infrared detectors, and a RC circuitry for delaying the onset of the audible alarm and employing two NPN transistors in a Darlington coupling for activating the audible alarm buzzer.

The electronic circuitry, shown in FIG. 8 is used to operate this device. The two infrared light detectors 5 and 6, FIG. 8 are parallel coupled. They are also coupled to a cadmium photocell 15, FIG. 8. This cadmium photocell is used for balancing for the varying ambient light intensity, received by the infrared light sensors 5 and 6, FIGS. 8. The other terminal of this cadmium photocell is connected to the positive terminal of the battery 16, FIG. 8. Across the cadmium photocell 15 it is parallel coupled a resistor 17, FIG. 8. For activating the audible alarm buzzer 18, FIG. 8, it is used two NPN transistors 19 and 20, FIG. 8, in a Darlington coupling. For the load resistance of the emitter 4, FIG. 8 it is used the second transistors 20, FIG. 8 voltage divider's, 21, FIG. 8 resistors in order to reduce current consumption by the infrared light emitting emitter 4. This voltage divider 21, FIG. 8 consists of resistors 22 and 23, FIG. 8. In order to increase the operating time of this this sleep prevention device for automobile drivers, preferably a lithium battery 16, FIG. 8 should be used instead of a carbon battery or an alkaline battery. Also a chargeable battery could be used.

In order to reduce the current consumption of the emitter, the simple infrared light detectors 5 and 6, shown in FIGS. 1, 2, 3, 4, 6, 7 and 8 could be replaced with Darlington coupled infrared light detectors, or the simple infrared light detectors 5 and 6, FIGS. 1, 2, 3, 4, 6, 7 and 8 could be replaced with Schmitt Trigger coupled infrared light detectors. In case two infrared light detectors are used, as shown in FIGS. 1, 2, 3, and 7, or in case three or more infrared light detectors are used, all of these infrared light detectors could be replaced either with Darlington coupled infrared light detectors or with Schmitt Trigger coupled infrared light detectors for reduced emitter current consumption.

In order to generate a slightly longer delayed audible alarm signal's beginning, the ground lead 24, FIG. 8 of the delay capacitor 25, FIG. 8, has to be connected to the negative pole of an auxiliary battery 26, FIG. 8. A potentiometer 27 between the infrared light detectors 5 and 6 and the base of the first transistor 19, FIG. 8 is used for adjusting the delay time for the audible alarm. The audible alarm's delay time is the time from the moment when the driver's eyes close until the moment when the audible alarm starts. Increasing the resistance of this potentiometer 27 increases the delay time. A series resistor 28 for the emitter 4 can be inserted into the electronic circuitry between the emitter and the positive terminal of the battery 16, FIG. 8, when a stronger infrared light signal from the emitter is required, for example because of bright ambient light during daytime driving in sunlight.

Electronic components according to the schematic shown in FIG. 8 are mounted onto a mounting bracket 29, FIG. 7. The audible alarm signal generator, a buzzer 18, FIGS. 7 and 8 is also mounted onto this mounting bracket 29, FIG. 7. Connector 30 is used to connect this driver's sleep prevention device to a car's cigarette lighter outlet instead of using a battery 16, FIG. 8 for powering the electronic circuitry, shown in FIG. 8.

The two infrared detectors 5 and 6, FIG. 7 are connected to the electronic components on the mounting bracket 29 by means of wires 31 and 32, FIGS. 7 and 8. Emitter 4 is connected to the electronics on the mounting bracket 29 by means of wires 33 and 34, FIGS. 7 and 8.

Figure 9:
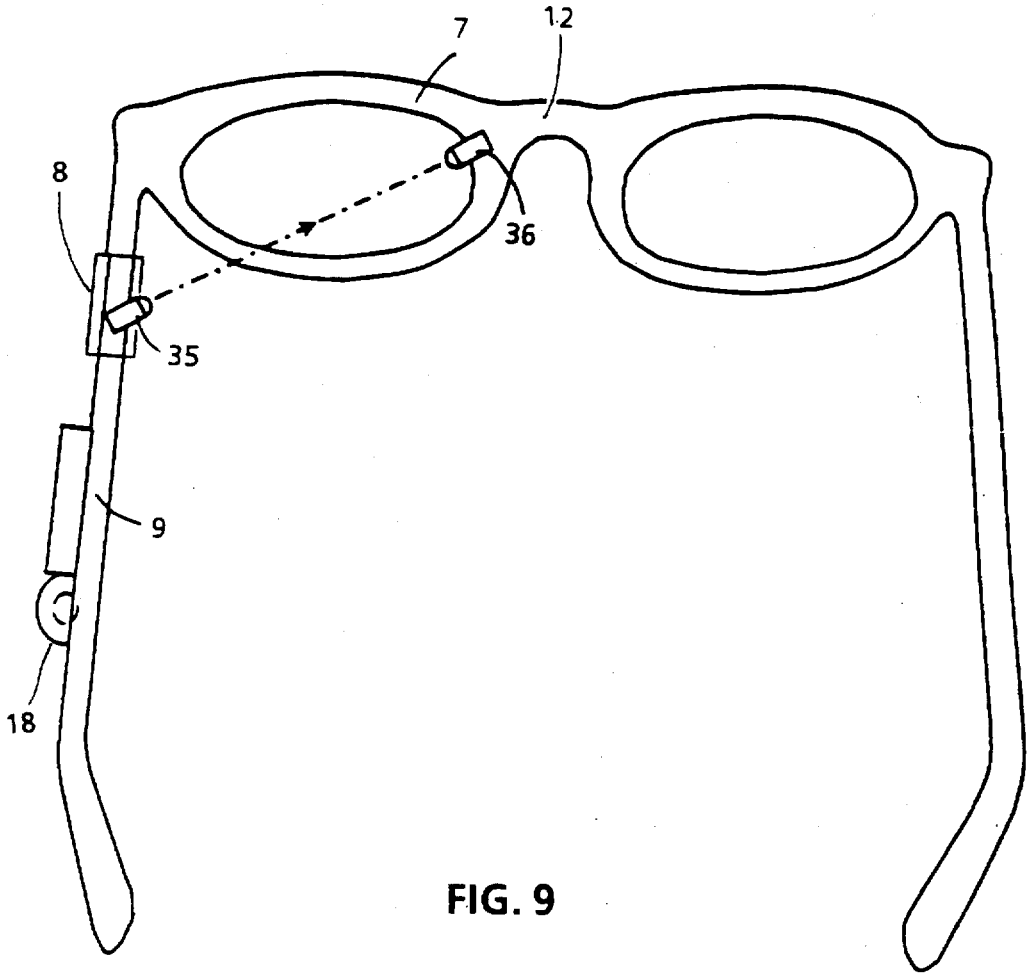
FIG. 9 is a perspective view of the sleep-preventing alarm device, attached to a pair of regular eyeglasses, which is using an ultrasonic transducer/transmitter and an ultrasonic transducer/receiver for analyzing the eye movements of a car driver.

FIG. 9 shows, how the ultrasonic transducer/transmitter 35 for generating the ultrasonic beam and the ultrasonic transducer/receiver 36 for receiving the ultrasonic beam, are mounted on the eyeglasses frame 7, FIG. 9. The ultrasonic transducer/transmitter 35, FIG. 9 for sending out the ultrasound beam, is mounted on a sliding block 8, FIG. 9, which slides along the temple 9 of the eyeglasses 7. The transducer/receiver 36 for receiving the ultrasonic beam, is mounted on the eyeglasses 7, FIG. 9 close to the eyeglasses bridge 12, FIG. 9. The ultrasonic frequency generator is shown in FIG. 10.

Figure 10:
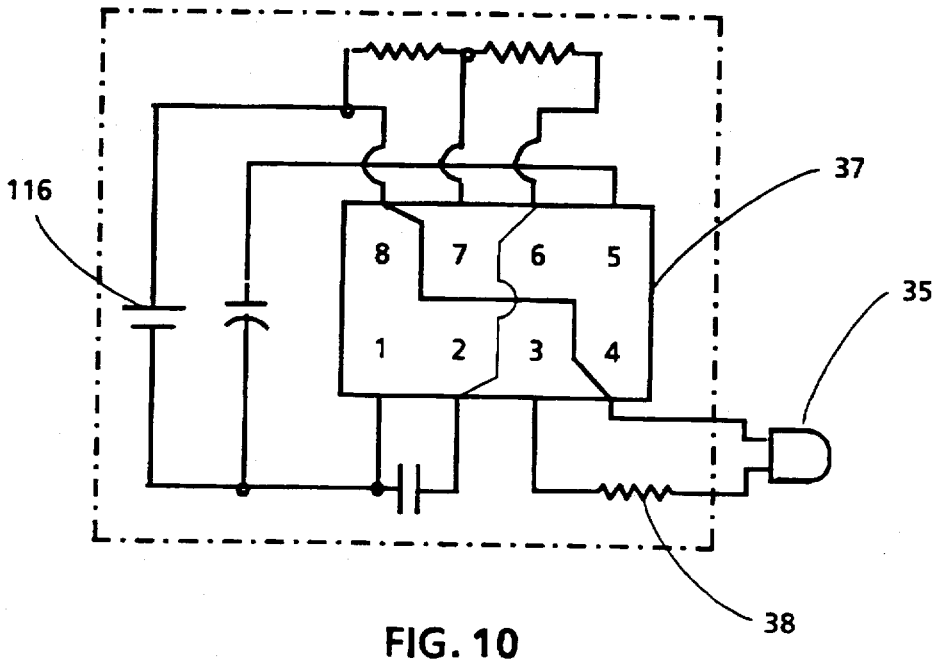
FIG. 10 shows the frequency generator for the ultrasonic transducer/transmitter.

For generating the ultrasonic beam, it can be used an integrated circuit IC 555, 37, FIG. 10.

For powering the ultrasonic generator 37, FIG. 10 it is used a battery 16. To the ultrasonic generator 37, FIG. 10 it is connected across a resistor 38 the ultrasonic transducer/transmitter 35 for sending out an ultrasonic beam.

Figure 11:
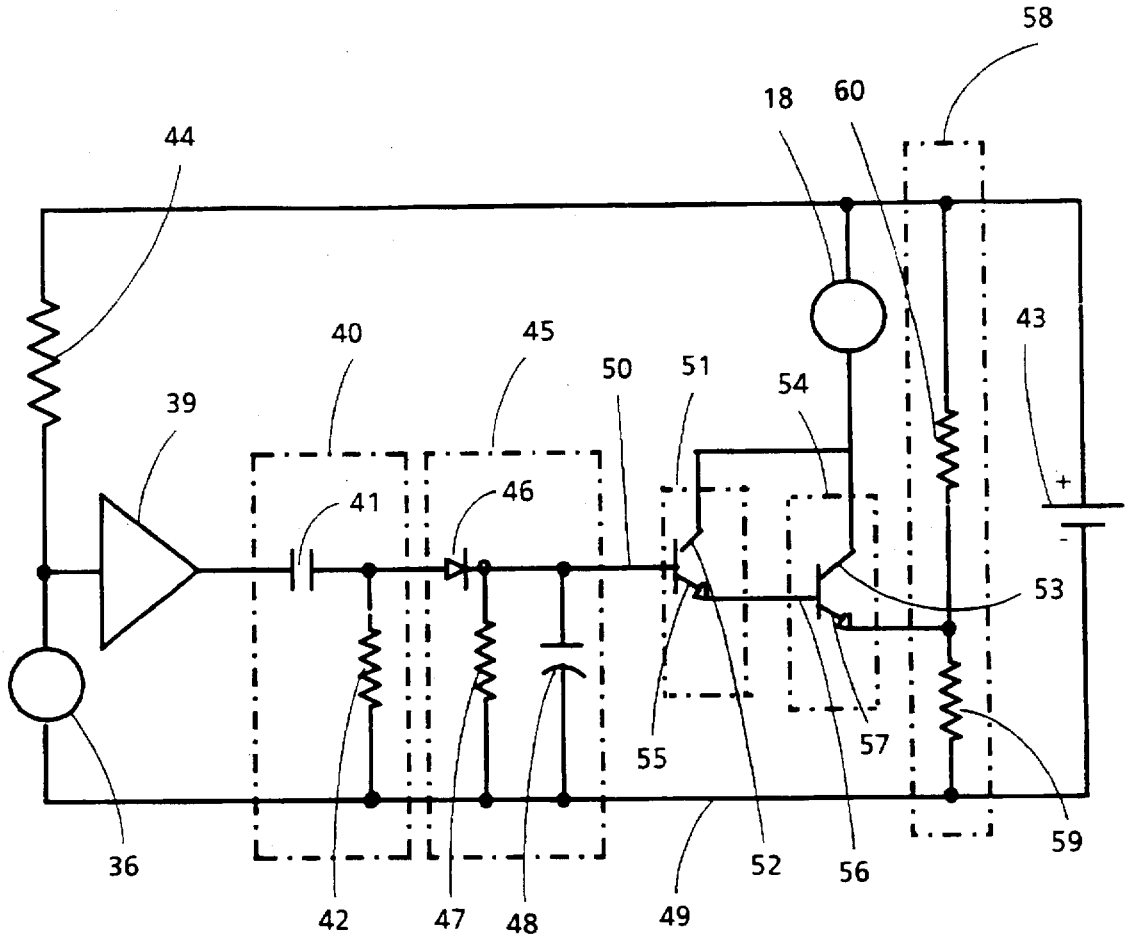
FIG. 11 shows the electronic circuitry for this sleep-preventing device, which is using ultrasonic transducers for analyzing the eye movements of a car driver.

FIG. 11 shows the circuitry for applying ultrasonic beam for eye movements detection and thus for preventing the car driver from falling asleep.

The ultrasonic transducer/receiver 36 is connected to the positive terminal of the battery 43 by means of a resistor 44.

The input signal from the ultrasonic transducer/receiver 36, FIG. 11 is first amplified by means of an amplifier 39, FIG. 11. The outout signal from this amplifier is then filtered by means of a filter circuitry 40, FIG. 11, consisting of a capacitor 41, FIG. 11 and a resistor 42, FIG. 11, in order to eliminate unwanted low frequency signals. The signal from this filter circuitry 40, FIG. 11 then goes to a detector circuitry 45, FIG. 11, which consists of a silicone diode 46, FIG. 11, connected to a resistor 47 parallel coupled with a capacitor 48, FIG. 11. The other end of this resistor and the other end of this capacitor are grounded to the ground lead 49. The output signal from this detector circuitry 45 is connected to the base 50 of the first NPN transistor 51 in a Darlington coupled circuitry. The collector 52 of this transistor and the collector 53 of the following transistor 54 are connected to the audible alarm buzzer 18, FIG. 11. The emitter 55 of the first NPN transistor 51 is connected to the base 56 of the second NPN transistor 54 in this Darlington coupling. The emitter 57 of the second transistor 54 is connected to a voltage divider 58, consisting of a resistor 59 connected to the ground lead 49 and another resistor 60, connected to the positive terminal of the battery 43.

Figure 12:
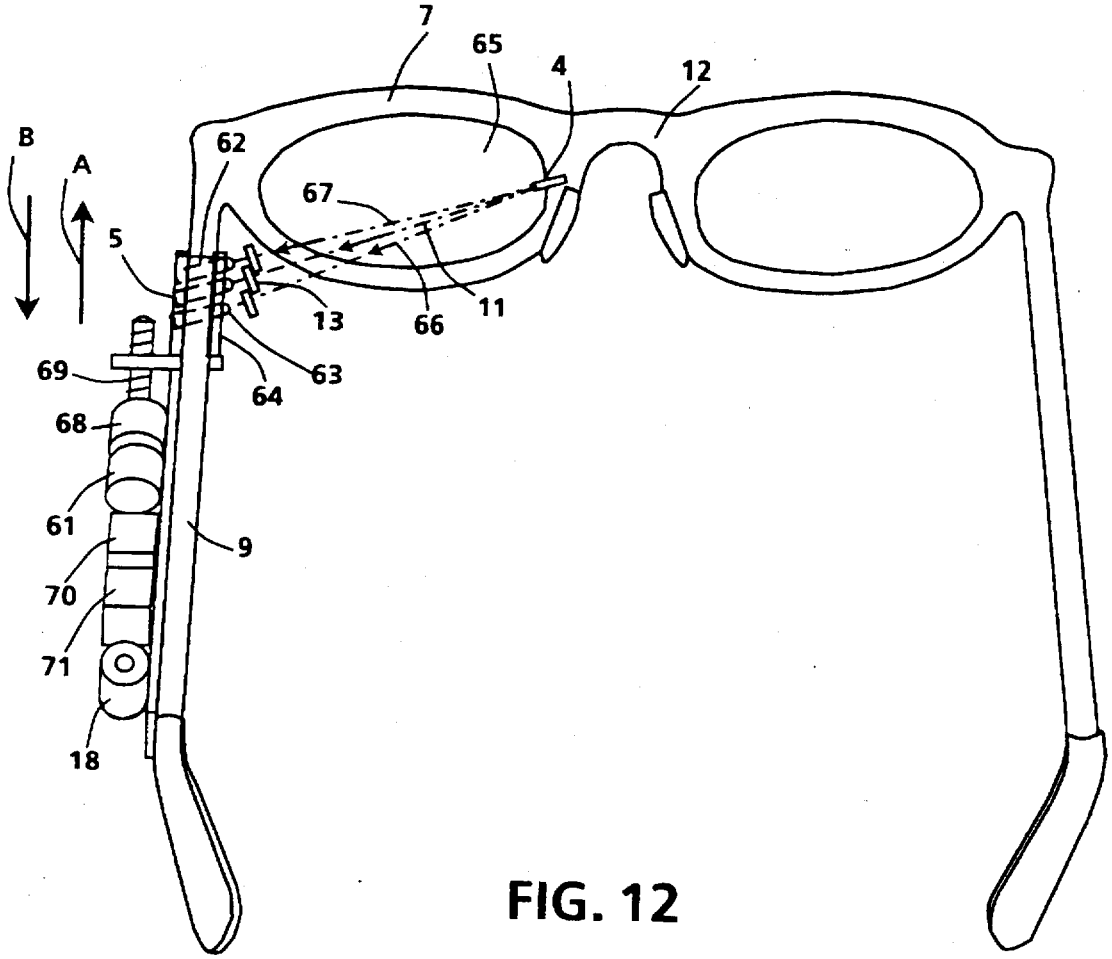
FIG. 12 is a perspective view of a sleep-preventing device, attached to a pair of regular eyeglasses, on the left temple of which is mounted a servomotor and a servomotor controlled sliding block, carrying three photodetectors, which are used for automatic positional adjustment of the eye movements analyzing infrared photodetector 5.

According to another, more sophisticated embodiment of this invention, it is used three infrared light beams for positioning of the eye movements analyzing infrared light beam very accurately in close proximity to the eye above the eye of the driver. This precise positioning is controlled by means of a servomotor 61, shown in FIG. 12. According to this embodiment of the current invention, the emitter 4 is mounted on the eyeglasses lens close to the bridge 12, FIG. 12 of the eyeglasses 7, FIG. 12. Three infrared photodetectors 5, 62 and 63, FIG. 12 are mounted onto the by the servomotor operated sliding block 64, which is moving forth and back along the left temple 9 of the eyeglasses 7, as shown in FIG. 12. The infrared light from the emitter 4, FIG.

Figure 13:
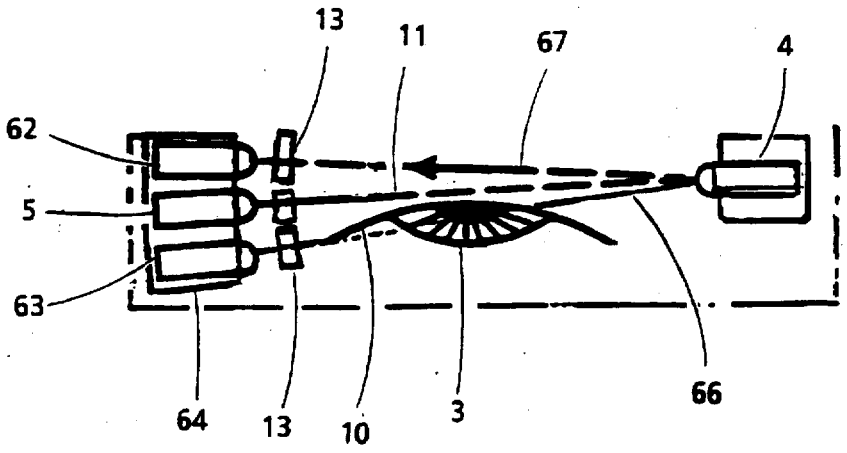
FIG. 13 is a horizontal cross section of the three photocells carrying a sliding block, showing the driver's eye position relative to the infrared light beam, which is going from the emitter 4 to the infrared light detector 5, FIG. 13.

12 is directed towards these three infrared light detectors. When the infrared light detectors 5 and 62, FIGS. 12 and 13 don't receive any light from the emitter, the servomotor 61, FIG. 12 is arranged to drive forward the sliding block 64 with the three infrared light detectors array (in direction A), closer to the left lens 65 of the eyeglasses 7, FIG. 12, until both of the infrared light detectors 5 and 62 are receiving the infrared light from the emitter 4, FIG. 12. In case the infrared light detector 63 is receiving infrared light from the emitter 4, FIG. 12, then the servomotor 61 is arranged to drive the sliding block 64, FIG. 12 backward (in direction B), farther away from the left eyeglass lens 65, FIG. 12, along the left temple 9, until this infrared light detector 63 doesn't receive any more infrared light from the emitter 4, FIG. 12. When this infrared light detector 63 doesn't receive any more infrared light, because the drivers eyeball 3, FIG. 13 is on the infrared light-beam's patch 66, FIG. 13 from the emitter 4 to the light detector 63 then the photocell 5, FIGS. 12 and 13 is in the right operating position. In FIG. 13 it is shown how the infrared light from emitter 4 is falling onto the three photodetectors 5, 62 and 63. In this FIG. 13 it is shown how the light beam 11, FIG. 13 from the emitter 4, FIG. 13 passes freely to the photodetector 5, FIG. 13, and how the infrared light beam 67 from the emitter 4 passes freely to the photodetector 62, FIG. 13, but the infrared light from the emitter 4 doesn't reach photodetector 63, because the light-beam 66 gets interrupted by the eyeball 3, FIG. 13, thus giving the servomotor 61, FIG. 12 a signal not to move the sliding block 64, FIGS. 12 and 13 with three photocells to any direction, because the sliding block 64, FIG. 12 is positioned just right 48.

In this way the second photocell 5, between the photocells 62 and 63 is always receiving the right closed eye/open eye information for operating the audible alarm signal circuitry properly.

For the brief time periods, when the servomotor 61, FIG. 12 is moving the sliding block 64 forth and back, the audible alarm buzzer 18, FIG. 8 for the alarm circuitry is disconnected to avoid giving any false alarm signals. This disconnection circuitry is not shown. The electronic circuitry for disconnection, for the time when the servomotor is working, can be done in several different ways.

The servomotor 61, FIG. 12 is connected to the gear reduction gearbox 68. The output worm gear 69 from this gearbox is moving the sliding block 64, FIG. 12, forth and back along the temple 9, FIG. 12. The motor control electronics 70 is mounted onto the left temple 9 together with the audible alarm signal generator 18, FIG. 12. The container 71, FIG. 12 with the electronic components necessary for activating the audible alarm signal is also mounted on the left temple 9, FIG. 12.

Figure 14:
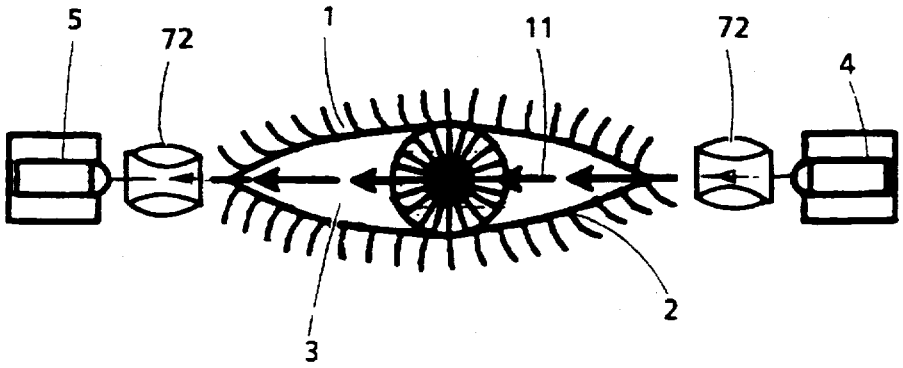
FIG. 14 shows two cylindrical lenses, which are making the sleep preventing device less critical to adjust. It also shows, how these cylindrical lenses are mounted relative to the driver's eye and relative to the infrared light emitter and the infrared light detector.
Figure 15:
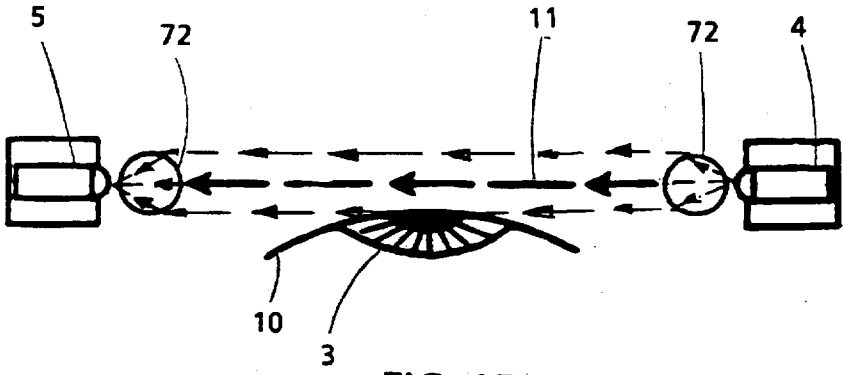
FIG. 15 is a horizontal cross-sectional view of the driver's eye, the cylindrical lens and the infrared emitter and the infrared detector, showing how the cylindrical lenses are mounted relative to the driver's eye and the infrared light emitter and the infrared light detector.

The cylindrical lenses 72 shown in FIGS. 14 and 15 are needed, to make the emitter to the detector light beam's 11 distance from the eye ball 3, FIG. 15 less critical. The half-cylindrical shaped lenses, not shown, work the same way. The cylindrical and half cylindrical lenses can be made of glass, acrylic plastic, any other plastic or any other transparent material.

In case the cylindrical lens in the front of the infrared light detector is turned 90°, it broadens the received light beam, thus when the driver looks downward, still a certain part of the emitted signal is received by the light detector and no false alarm signal is generated.

Figure 16:
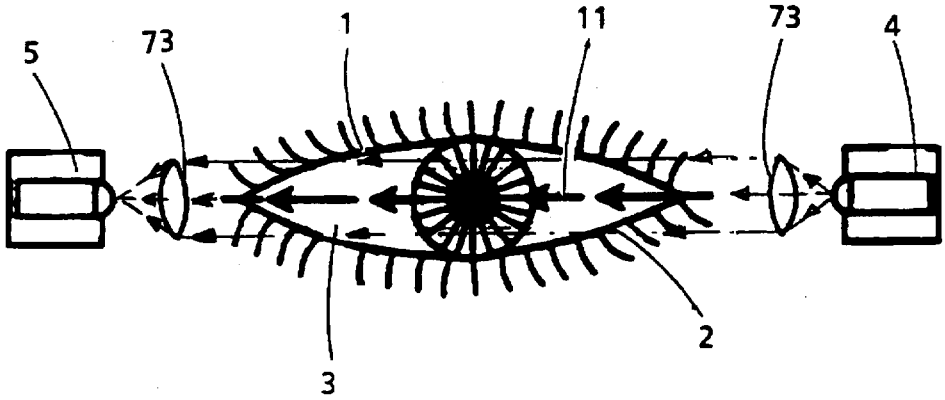
FIG. 16 shows how two convex lenses are mounted relative to the driver's eye and relative to the infrared light emitter and the infrared light detector.
Figure 17:
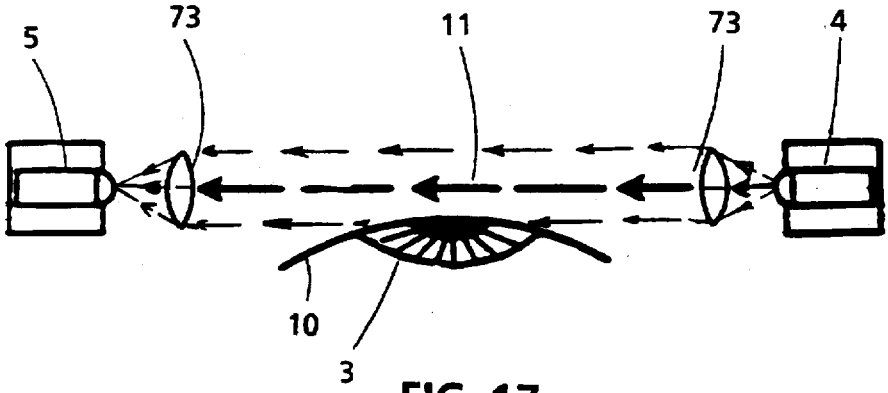
FIG. 17 is a horizontal cross-sectional view of the driver's eye, the convex lenses and the infrared emitter and the infrared detector, showing how the convex lenses are mounted relative to the driver's eye and the infrared light emitter and the infrared light detector.

Regular convex lenses 73, shown in FIGS. 16 and 17 can also be used to make the emitter-to detector light beam's 11 distance from the eyeball 3, FIG. 17, less critical.

In case there are spatial constrictions for the mounting of these cylindrical or convex lenses onto the eyeglasses, only one of these lenses may be used, for example, only one cylindrical or convex lens may be used in front of the infrared light detector. The light beam positioning relative to the eyeball 3, FIG. 15 will still be less sensitive to the light beam's position, than when using this sleep prevention device without any lens.

The infrared filter 13, FIGS. 7, 12 and 13 in front of the infrared light detectors is used in order to reduce the ambient light's influence to this driver's sleep prevention alarm device.

FIG. 7 shows, how according to this invention the emitter 4, FIG. 7 is mounted onto a sliding block 8, FIG. 7 movable along the left temple 9 of the eyeglasses 7, FIG. 7, as described earlier.

Figure 18:
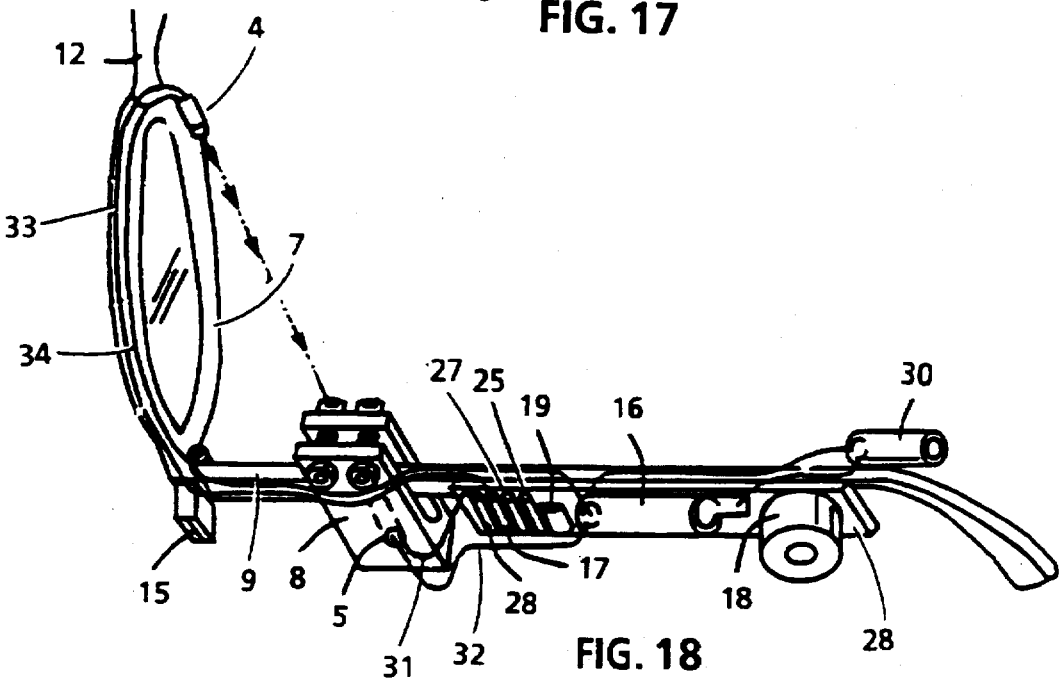
FIG. 18 is a perspective view of the sleep-preventing alarm device, attached to a pair of regular eyeglasses according to another embodiment of the present invention, where the emitter is attached to the eyeglasses close to the bridge of the eyeglasses and the light detector is attached to the sliding block, which is movable along the temple of the eyeglasses.

FIG. 18 shows how according to this invention, the emitter, FIG. 18 is mounted close to the bridge 12, FIG. 18 of the eye-glasses 7 and an infrared light detector 5, FIG. 18 is mounted onto the sliding block 8, FIG. 18, movable along the left temple 9, FIG. 18 of the eyeglasses 7, FIG. 18. For daylight driving the configuration, which is shown in FIG. 18 has this advantage, that the ambient light can not as easily fall onto the infrared light detector 5, FIG. 18 as in the case when the infrared light detector 5 is mounted close to the bridge 12, FIG. 7 of the eyeglasses 7, FIG. 7 and facing the left driver-side window.

During daytime driving the ambient daylight can influence this driver's sleep preventing alarm device. In order to reduce the ambient light's influence which contains also a certain amount of infrared light, the eyeglasses 7, FIG. 7 have to be coated with a heat reflecting coating 74, FIG. 7 or covered with an infrared light reflecting film.

Also a shield 75, FIG. 7 of an infrared light reflecting material has to be mounted close to the left temple 9, FIG. 7 of the eyeglasses 7 as shown in the FIG. 7. This shield can be either transparent or opaque. It can be made of plastic, glass or thin film of an infrared light reflecting material.

Figure 19:
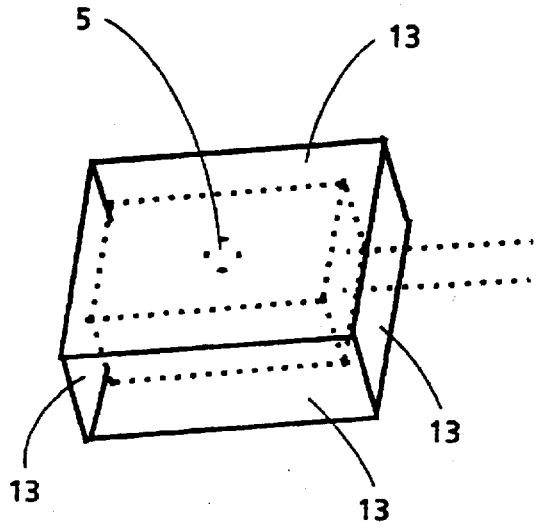
FIG. 19 is showing how a photodetector, according to the present invention, is enclosed in all it's 6 sides by means of infrared filters, for example by means of Eastman Kodak gelatine filter number 87.

For daytime driving all the infrared light detectors 5, 6, 62 and 63, which are shown in FIGS. 1, 2, 3, 4, 6, 7, 8, 12, 13, 14, 15, 16, 17 and 18 of this driver sleep preventing device, have to have an infrared filter 13 mounted also in the infrared light detector's back and on all the sides of infrared light detectors, as shown in FIG. 19, in order to prevent daylight from interfering with the sensor circuitry of this driver wake-up device. FIG. 19 shows the infrared filters 13, FIG. 19, for ex Wratten filter #87, covering a photodetector 5, FIG. 19 at its all 6 sides.

In order to increase considerably the battery life of this sleep prevention device for automobile drivers, it can be used infrared light pulses from the infrared light emitter, instead of continuous infrared light.

Figure 20:
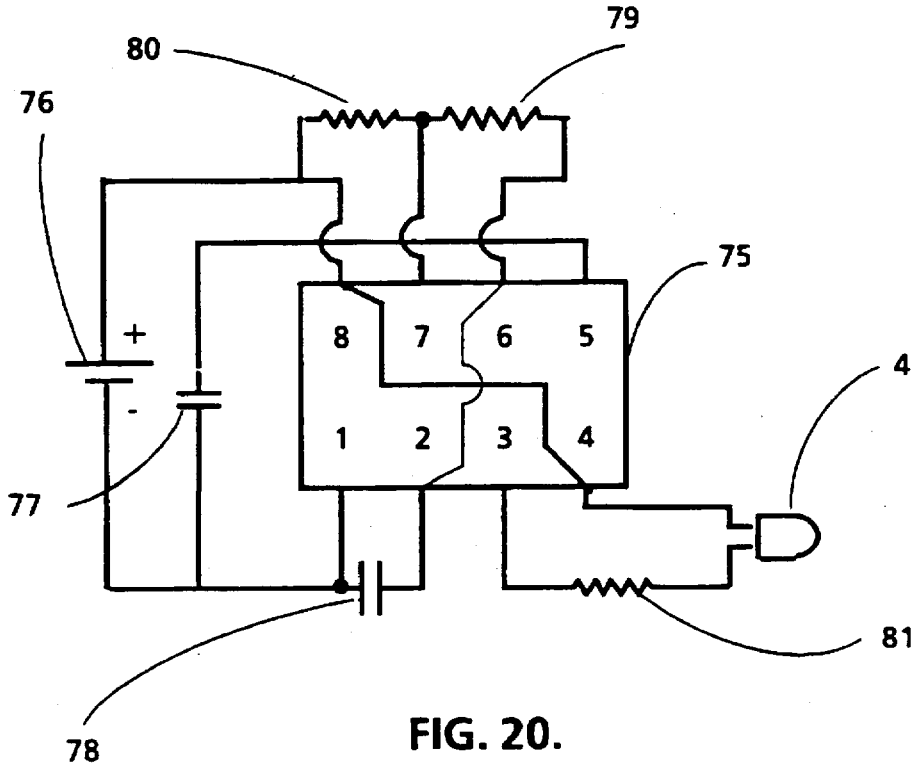
FIG. 20 shows the electronic circuitry for generating pulsed emitter light.

The infrared light pulses are generated for this purpose by means of a circuitry, shown in FIG. 20. In this circuitry, for generating a continuous series of short infrared light pulses it is used a low current integrated timer circuit 75, FIG. 20. Preferably a low current integrated timer circuit LS 555 can be used. The positive voltage from a battery 76 is applied to the terminal 8, and to the terminal 4 of this integrated timer circuit 75, IC LS55; the ground (the negative terminal of the battery) is connected to the terminal 1 of this integrated circuit IC 75, LS 555. Between the terminals 1 and 5 of this integrated timer circuit 75, IC LS 555 is connected a capacitor 77, with capacity usually 0.01 uF. Between the terminals 1 and 2 of this integrated timer circuit 75, IC LS 555 is connected a capacitor 78, which defines which frequency the generated pulse train will have.

Between the terminals 6 and 7 of this integrated timer circuit 75, IC LS 555 it is connected a resistor 79, with a value R. Between the terminals 7 and 8 of this integrated timer circuit 75, IC LS 555, is connected another resistor 80, with a value for example 20 times R. This will roughly give a pulse train where the pulse time duration is only about 1/20th of the time between the pulses.

The output terminal 3 of this Integrated timer circuitry 75, IC LS 555, is connected across a resistor 81 to the infrared light emitter 4, FIG. 20. The other end of this infrared light emitter 4, FIG. 20 is connected to the terminal 4 of this integrated timer circuitry 75, IC IS 555.

Figure 21:
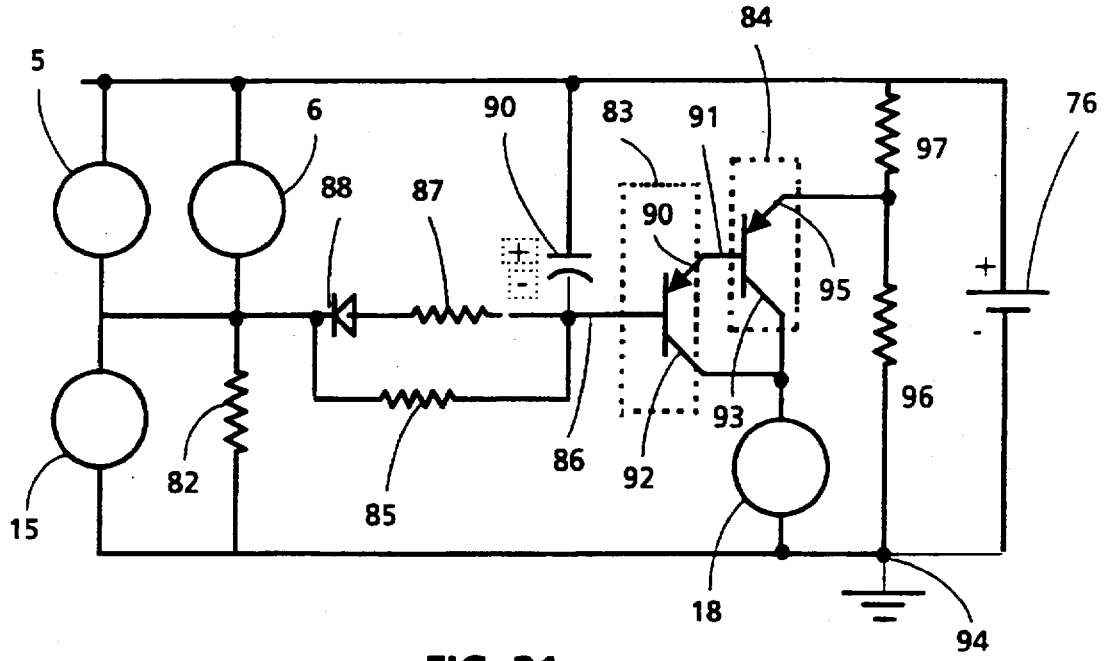
FIG. 21 shows the electronic circuitry for receiving driver's eye analyzing signals by means of pulsed emitter light.

For receiving these infrared pulses from the infrared light emitter, it is used the electronic circuitry, shown in FIG. 21.

The two infrared light detectors 5 and 6, FIG. 21 are parallel coupled. One terminal of these two infrared light detectors is connected to the positive terminal of the power supply 76.

The other terminals of these infrared light detectors 5 and 6, FIG. 21 are coupled to a cadmium photocell 15, FIG. 2. The other terminal of this cadmium photocell 15, FIG. 21 is connected to the negative terminal of the battery 76, FIG. 21. Across the cadmium photocell 15 it is parallel coupled a resistor 82, FIG. 21.

For activating the audible alarm buzzer 18, FIG. 21 it is used two PNP transistors 83 and 84, FIG. 21, in a Darlington coupling.

The common point of the two infrared light detectors and of the cadmium photocell is connected via a resistor 85 to the base 86 of the first transistor 83 in the Darlington coupling.

The resistor 85 is parallel coupled with a diode 87 in series with a resistor 88. The base 86 of the first transistor 83 in the Darlington coupling is also connected to a capacitor 89. The other end of this capacitor 89 is connected to the positive terminal of the battery 76, FIG. 21. The emitter 90 of the first PNP transistor 83 is connected to the base 91 of the second PNP transistor 84 in this Darlington coupling. The collectors 92 and 93 of both of these PNP transistors 83 and 84 are connected to the buzzer 18, FIG. 21. The other terminal of the buzzer 18 is connected to the negative terminal 94 of the battery 76, FIG. 21. The emitter 95 of the second PNP transistor 84 in this Darlington coupling is connected across a resistor 96 to the minus terminal 94 of the battery and across a resistor 97 to to the positive terminal of the battery 76.

Figure 22:
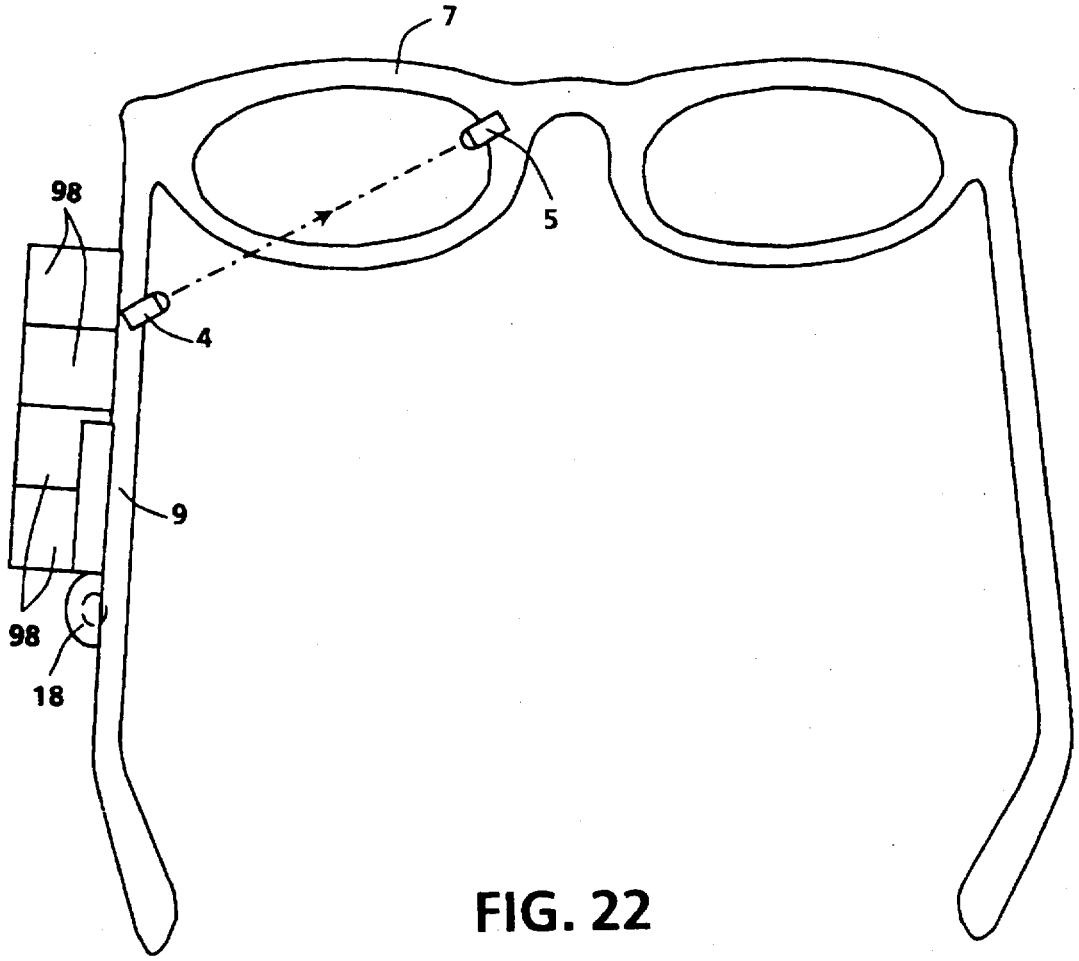
FIG. 22 is a perspective view of the sleep preventing alarm device, attached to a pair of regular eyeglasses, according to the present invention, where a bank of solar cells is attached to one of the eyeglasses temples to power the electronic circuitry.

In order to eliminate the battery use completely, a number of series coupled solar cells 98, as shown in FIG. 22, can be used. FIG. 22 shows how four series copied solar cells 98 are mounted onto the left temple 9, FIG. 22 of the eyeglasses 7, FIG. 22 of the car driver.

Figure 23:
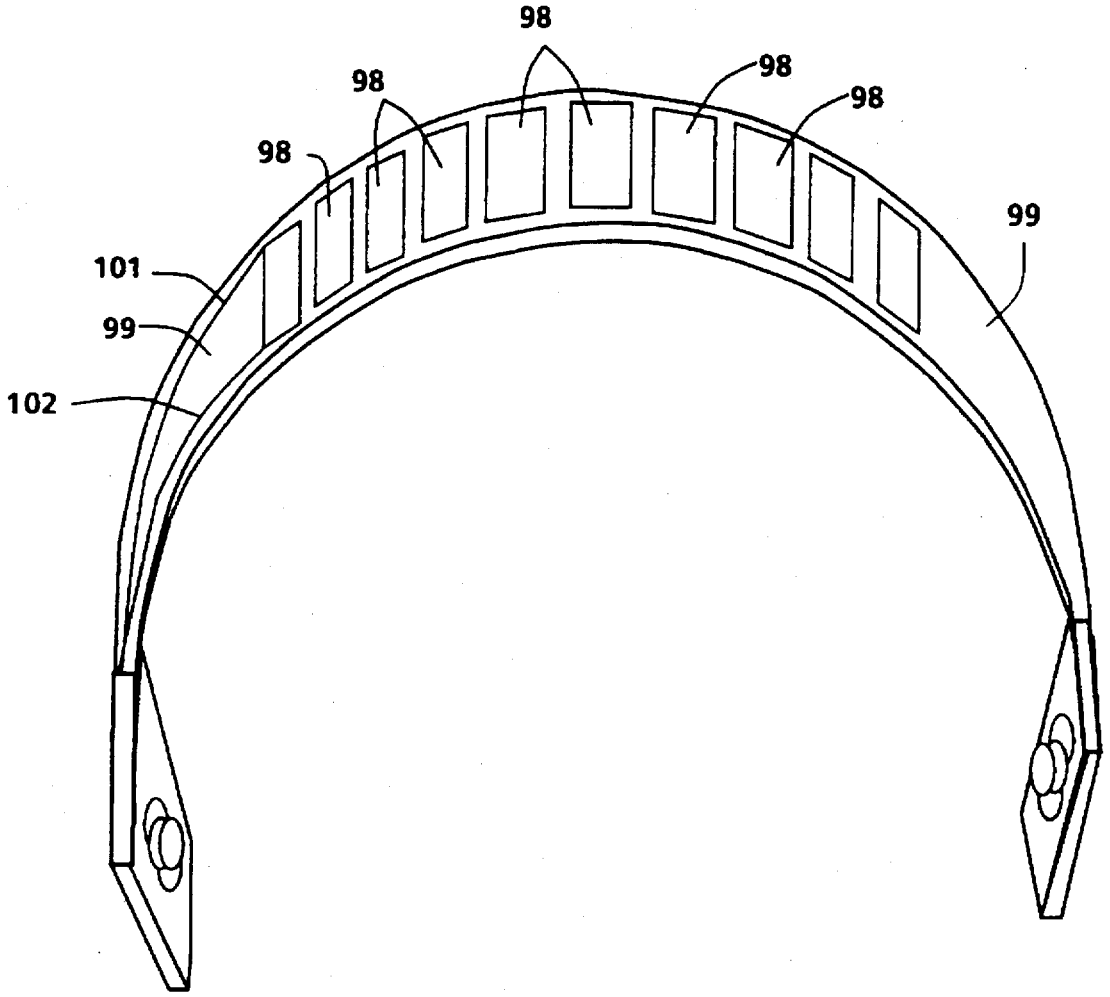
FIG. 23 is perspective view of an headband onto which is mounted a bank of solar cells to power the electronic circuitry according to the present invention.
Figure 24:
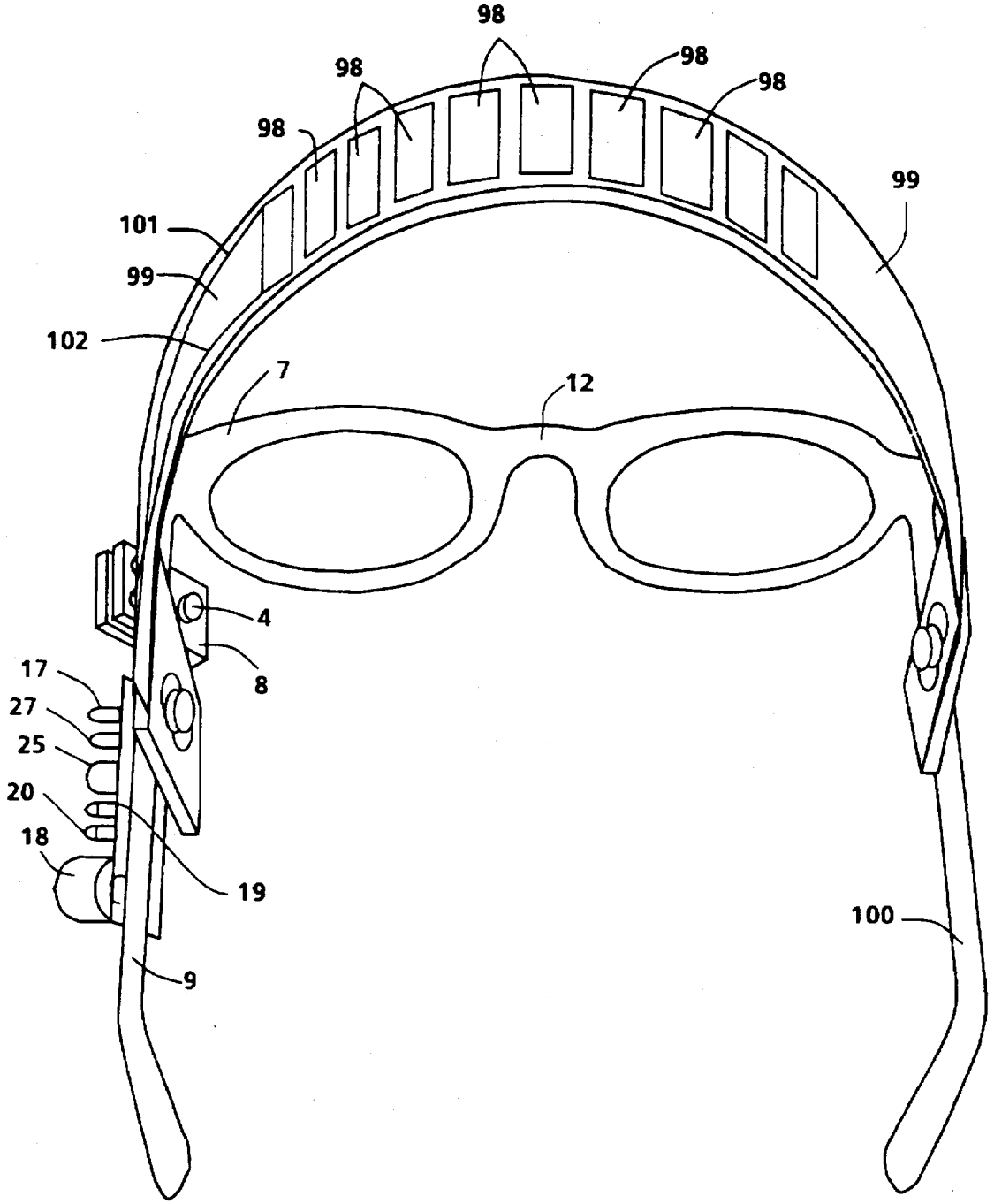
FIG. 24 is perspective view of an headband, attached to a pair of eyeglasses, onto which is mounted a bank of solar cells to power the electronic circuitry according to the present invention.

Alternately these series coupled solar cells 98 can be mounted onto a head-band 99 shown in FIGS. 23 and 24, which is stretching from the left temple 9, FIG. 24 of the eyeglasses 7, FIG. 24 to the right temple 100, FIG. 24 of the eyeglasses. This head-band 99, FIG. 23 and 24 is made adjustable, so that it will fit properly for every car driver. The current carrying wires 101 and 102, FIG. 24 from these series coupled solar cells 98 FIG. 24, which are mounted onto this headband 99, FIG. 24 are connected to the electronics of this sleep prevention device for automobile drivers.

Figure 25:
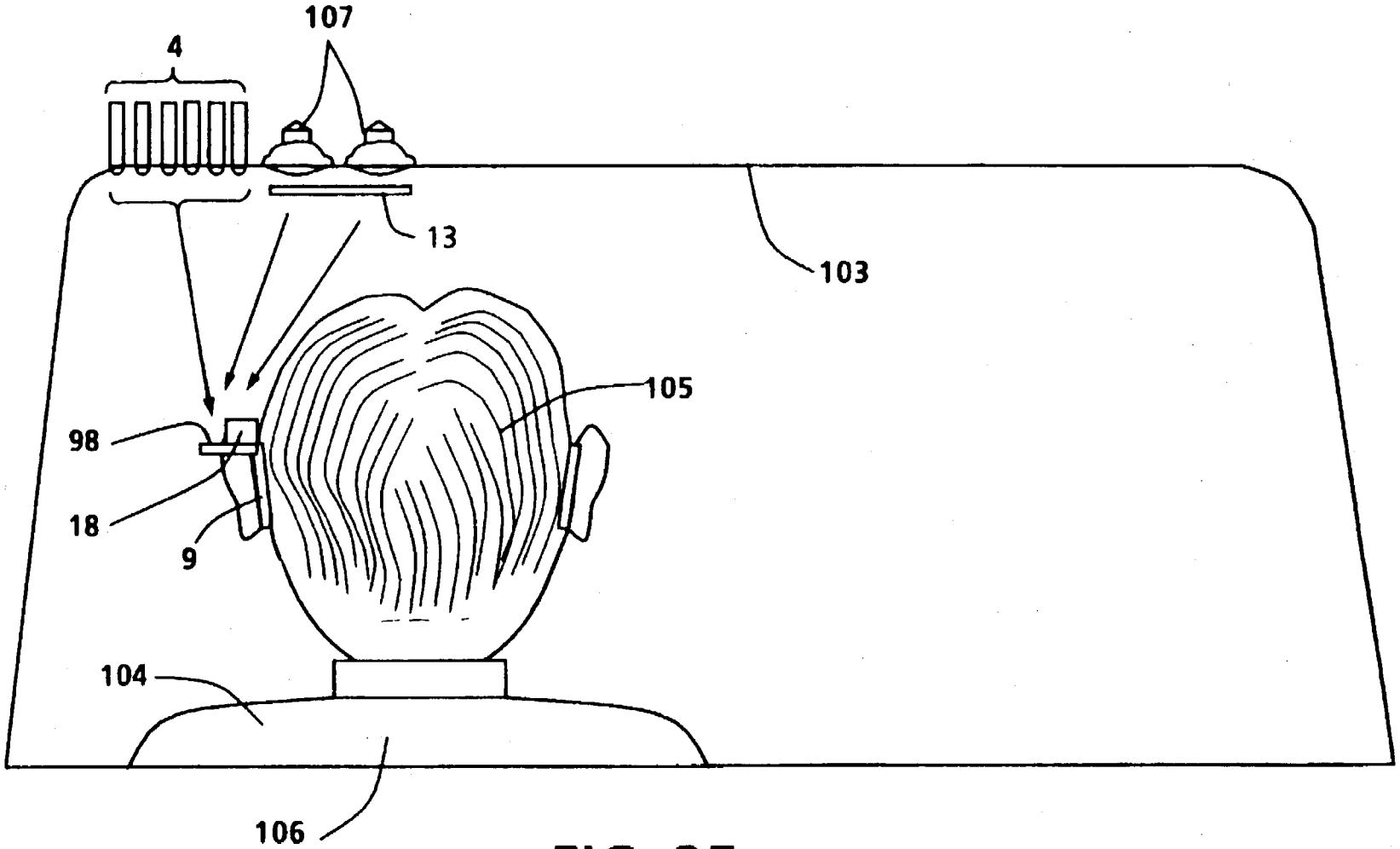
FIG. 25 shows a car driver in the driver's seat of a car, wearing eyeglasses according to the present invention, where for powering of the electronic circuitry it is used a bank of solar cells mounted onto the left temple of the driver's eyeglasses.

To energize these solar cells 98, FIGS. 22, 23 and 24, a bank of infrared light emitters 4, FIG. 25 is mounted onto the ceiling 103, FIG. 25 of the car just above the left shoulder 104 and above the head 105 of the car driver 106, FIG. 25. Also regular incandescent lamps 107, FIG. 25 can be used, with infrared filters 13, FIG. 25 in front of them. These incandescent lamps can be mounted onto the car's ceiling above the left shoulder 104 and above the head 105 of the car driver 106, FIG. 25. The infrared radiation from these infrared emitters and incandescent lamps will generate in the series coupled solar cells 98, FIGS. 22, 23, 24 and 25 enough current for operating the emitter 4, for operating the audible alarm generator 18, FIG. 8 and for operating the rest of the electronic circuitry, shown in FIG. 8.

Figure 26:
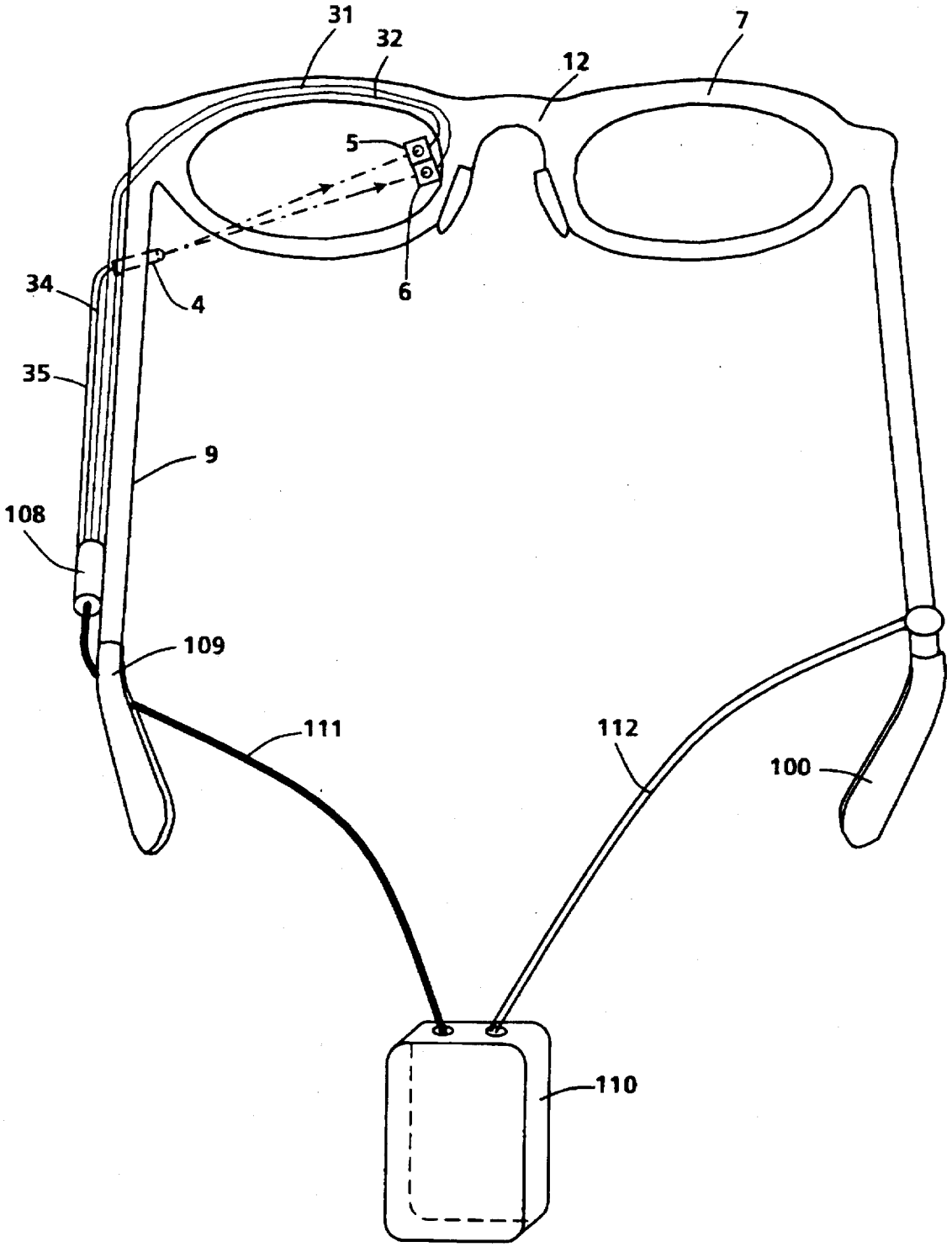
FIG. 26 shows a very lightweight embodiment of this invention, where onto the eyeglasses is attached only two infrared light detectors, an emitter and a connector for a cable. The necessary electronics and the audible alarm buzzer are packaged into a tiny box, hanging down from the eyeglasses to the chest or the lap of the driver.

In order to make this sleep preventing device for automobile drivers so light-weight as possible, the eyeglasses 7, FIG. 26 can have only the two infrared light detectors 5 and 6 mounted close to the bridge 12, FIG. 26 of the eyeglasses and the emitter 4, FIG. 26 mounted on one of the temples 9 or 100 as shown in FIG. 26. Two wires 31 and 32 from the two parallel coupled photodetectors 5 and 6 and two wires 33 and 34 from the emitter 4 are going from the Infrared light detectors and from the infrared light emitter to a connector 108, FIG. 26, mounted on the end-part 109 of the temple 9, FIG. 26. In this way the inventions components, which are mounted onto the eyeglasses 7, will weigh less than two grams. The necessary electronics, battery for this device and the driver wake-up audible alarm signal buzzer 18 are packaged into a little box 110, which is with a four wire cable 111 connected to the connector 108 in the end of the temple 9, FIG. 26. This little box is hanging with the connecting cable 111, FIG. 26 down from the temple 9, FIG. 26 and it is connected to the other temple 100, FIG. 26 with a flexible string 112, FIG. 26. The user of this sleep preventing device for automobile drivers can either let this box hang on his or her chest or insert it into his or her shirt pocket. Ladies can attach this little box with a decorative pin onto their shirts or dresses.

Figure 27:
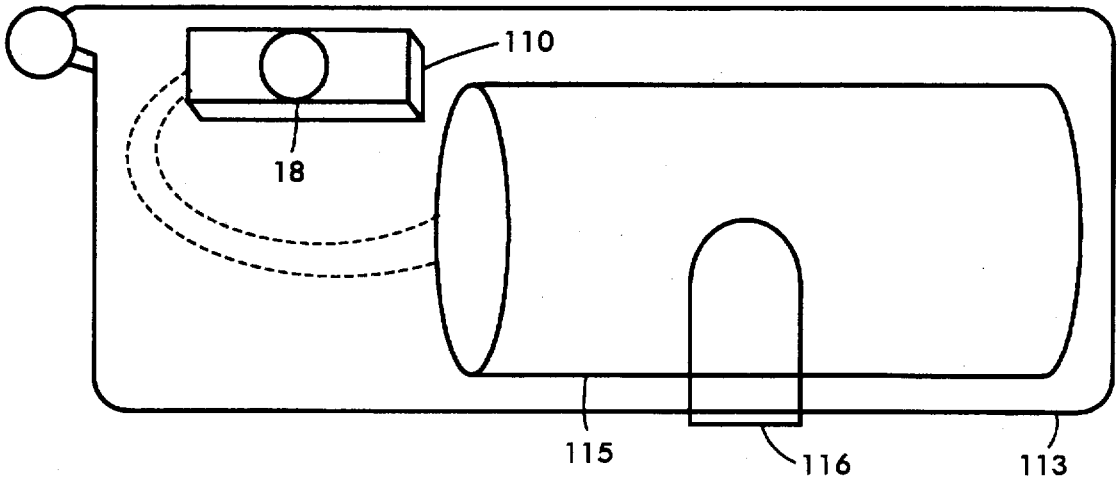
FIG. 27 shows a view of a driver-side visor of an automobile. Onto this visor it is mounted a very lightweight embodiment of this invention, which is designed as a part of a new car, built as an safety accessory for a car, where onto the eyeglasses is attached only two infrared detectors, an emitter and a connector for a coiled short wire. The necessary electronics and the audible alarm buzzer are packaged into a tiny box, mounted onto the driver-side visor of the car. When the eyeglasses are not used, these are inserted into a eyeglasses case, which is attached with a clamp to the driver side visor, or mounted on the driver side visor permanently.
Figure 28:
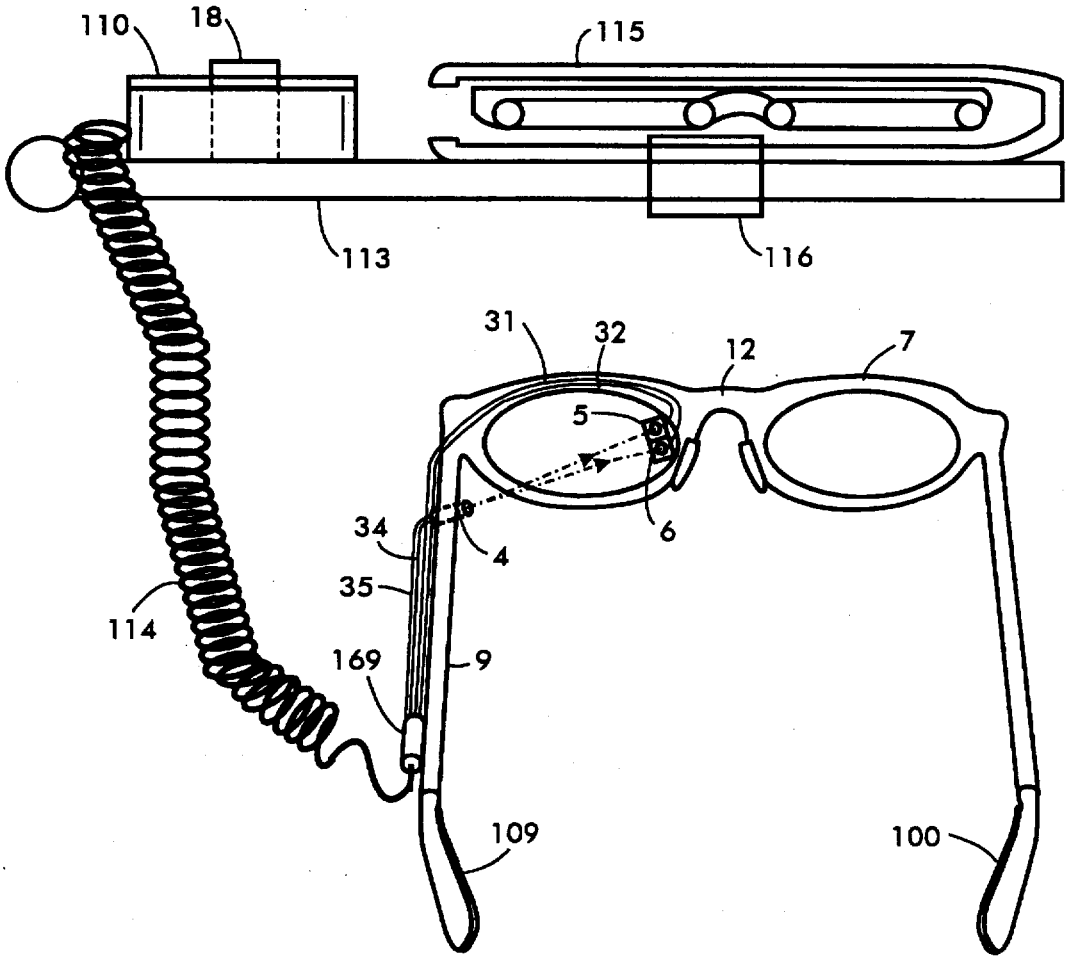
FIG. 28 shows this lightweight embodiment of the invention in use, taken out from the eyeglass case and connected with a stretchable coiled wire to the driver side visor.

This little box 110 with necessary electronics according to FIG. 8, and with the audible alarm signal buzzer 18 for the alertness signal for an automobile or truck driver can be attached with a clamp or can also be mounted permanently onto the driver-side visor 113 of the vehicle, as shown in FIGS. 27 and 28. For powering this device, its electronics can be permanently connected to a standard 12 volts car battery, or its electronics can be connected removably to the cigarett lighter outlet of this automobile. Instead of using a buzzer, this buzzer can be replaced with a relay, which is arranged to connect the 12 volts car battery with the horn of the automobile, in order to to generate a loud audible alertness signal for the car driver in FIG. 28 it is shown, how the connection from this box 110, FIG. 28 on the visor 113, FIG. 28 to the eyeglasses 7, FIG. 28 according to the present invention is done by means of a four wire coiled cable 114, FIGS. 27 and 28 for flexibility. This cable 114, FIG. 28 can be provided also with an easy release connector 115, FIG. 28. In case the car driver steps out of the car, forgetting that he has these eyeglasses connected with the necessary electronics box 110 on the visor 113, FIG. 27 and 28, the easy release connector 115 just disengages itself.

During the time, when these driver alertness eyeglasses are not used, these eyeglasses can be stored in an eyeglass holder 115, FIGS. 27 and 28, clamped onto the visor 113 with a clamp 116, FIGS. 27 and 28 or permanently mounted onto the visor 113, as shown in FIGS. 27 and 28.

Figure 29:
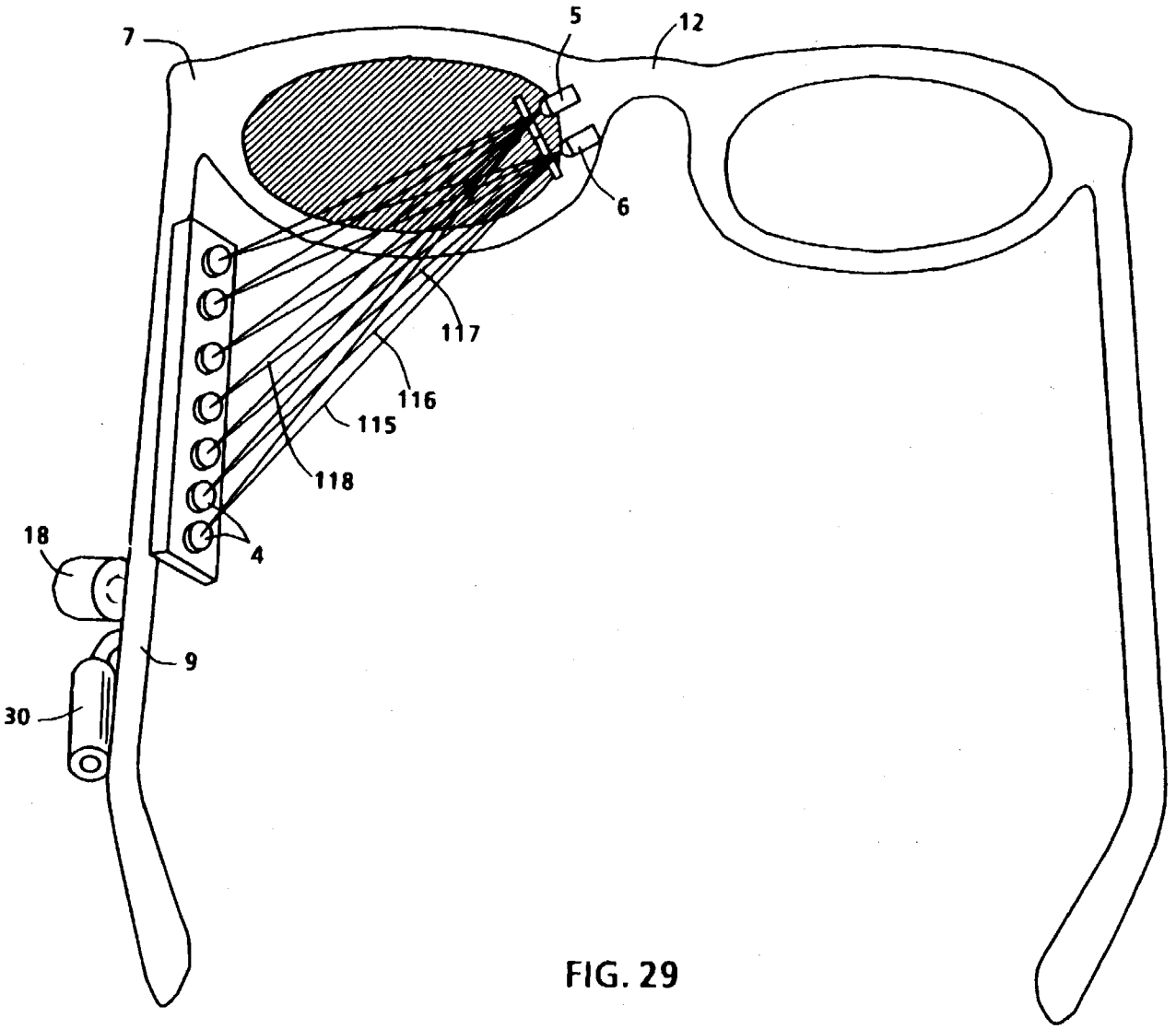
FIG. 29 shows an embodiment of this invention where the positioning of the beam from the emitters to the infrared detectors is accomplished electronically.
Figure 30:
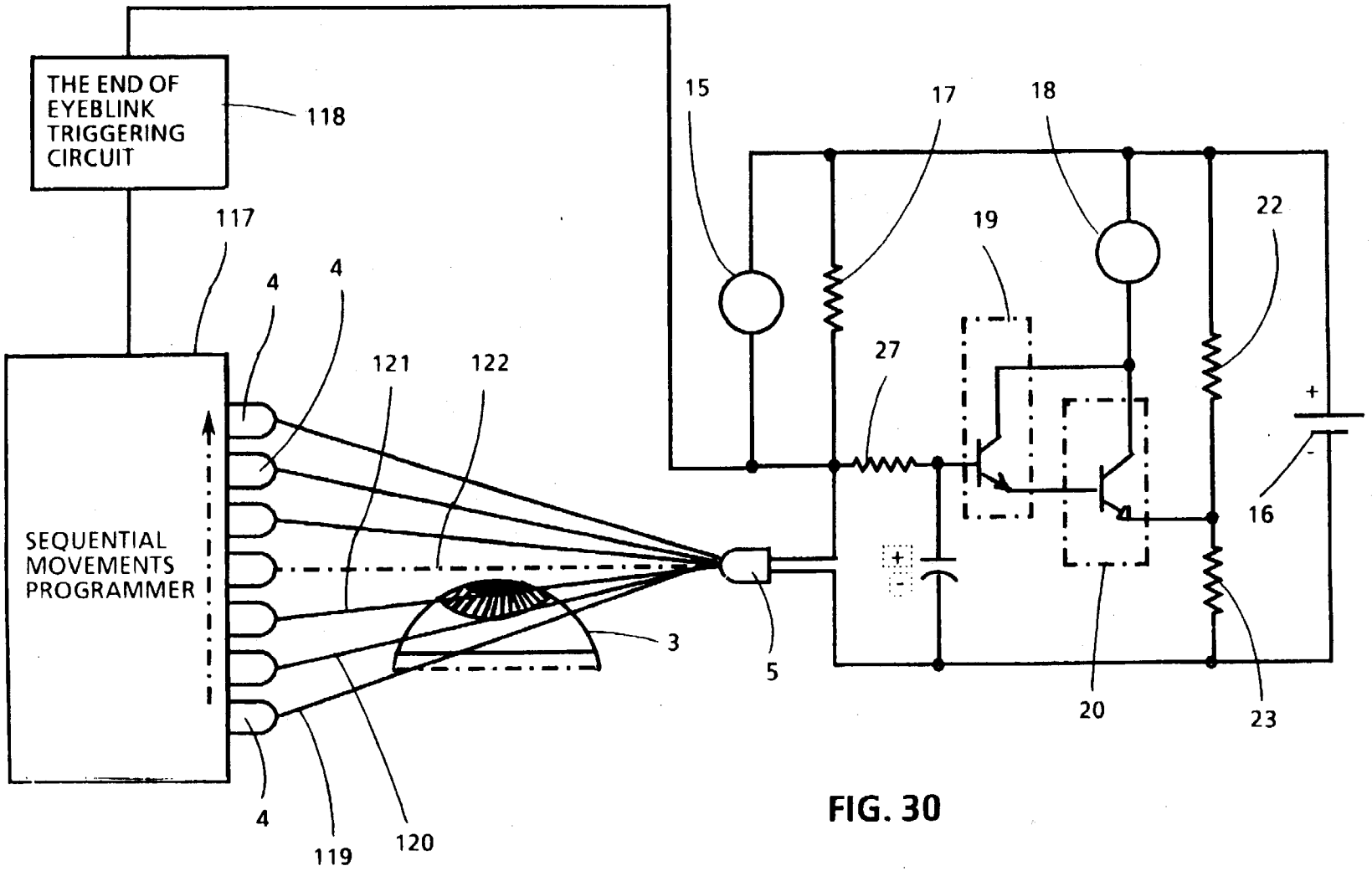
FIG. 30 shows how this positioning is accomplished by means of sequential switching on and off each of the emitters in a bank of emitters, mounted onto the temple of the eyeglasses.

The ultimate sleep preventing device for automobile drivers, is an electronically controlled beam positioning device, shown in FIGS. 29 and 30. According to this embodiment of the present invention, the infrared light beams from a number of emitters 4, FIG. 29, mounted next to each other on one of the temples, 9, FIG. 29 of the eyeglasses, are sequentially activated.

In FIG. 30 it is shown how these emitters 4, FIG. 30 are activated sequentially by means of a programmer 117, FIG. 30, for sequential switching of these emitters. From the photodetector 5, FIG. 30 it i taken the negative slope of a pulse, characterizing the end of a blink by the driver's eye, pulse formed by means of the end of the eyeblink triggering circuitry 118, FIG. 30 and used as the starting point of sequential activation of the emitters 4, FIGS. 29 and 30.

From the first emitter 4 received beam 119, FIG. 30 is analyzed by means of the photodetector 5, FIG. 29 circuitry. In case this beam 119 is blocked by the eyeball 3, FIG. 30, then the next infrared beam 120 is activated. In case it is also blocked by the eyeball, then the next infrared beam 121 is activated. In case this infrared beam is also blocked by the eyeball 3, FIG. 30, then the next infrared beam 122 is activated. In case this infrared beam passes the eyeball, the beam will stay in this position a certain length of time, for driver's eyelid movements analyzing.

After a certain length of time has passed, for example one minute, the sequential activation of the row of emitters will start again at the next blink of the eye by the automobile driver.

Electrically the triggering of the sequential activation of the row of the emitters starts at the negative slope of a pulse, which is generated by the end of a blink of the drivers eye. In this way the sequential activation of the row of emitters will not start just at the moment when the driver's eyes have been closed, because he is bound to fall asleep.

In FIG. 30 it is shown how he emitters are activated sequentially by means of a sequential movement programmer 117, FIG. 30.

From the photodetector 5, FIG. 30 it is taken the negative slope of a pulse, characterizing a blink by the driver's eye, pulse formed in the end of eyeblink triggering circuit 118, FIG. 30 and used to start a new sequential activation of the infrared emitters 4, FIG. 30

This sequential beam positioning can be done also when only one emitter is used, which is mounted on the eyeglasses lens close to the bridge of the eyeglasses, and a certain number of infrared light detectors is used, mounted in a row on a bracket, which is attached to one of the temples of the eyeglasses. The sequential switching of the infrared beam between various positions from one infrared photodetector to the next is done in similar way as it is done when the beam is switched from one infrared emitter to the next, as shown in FIG. 30. A circuitry for sequential switching of the detectors will replace the sequential switching circuitry for emitters 117, but the end of eyeblink triggering circuitry 118 will stay the same.

Figure 31:
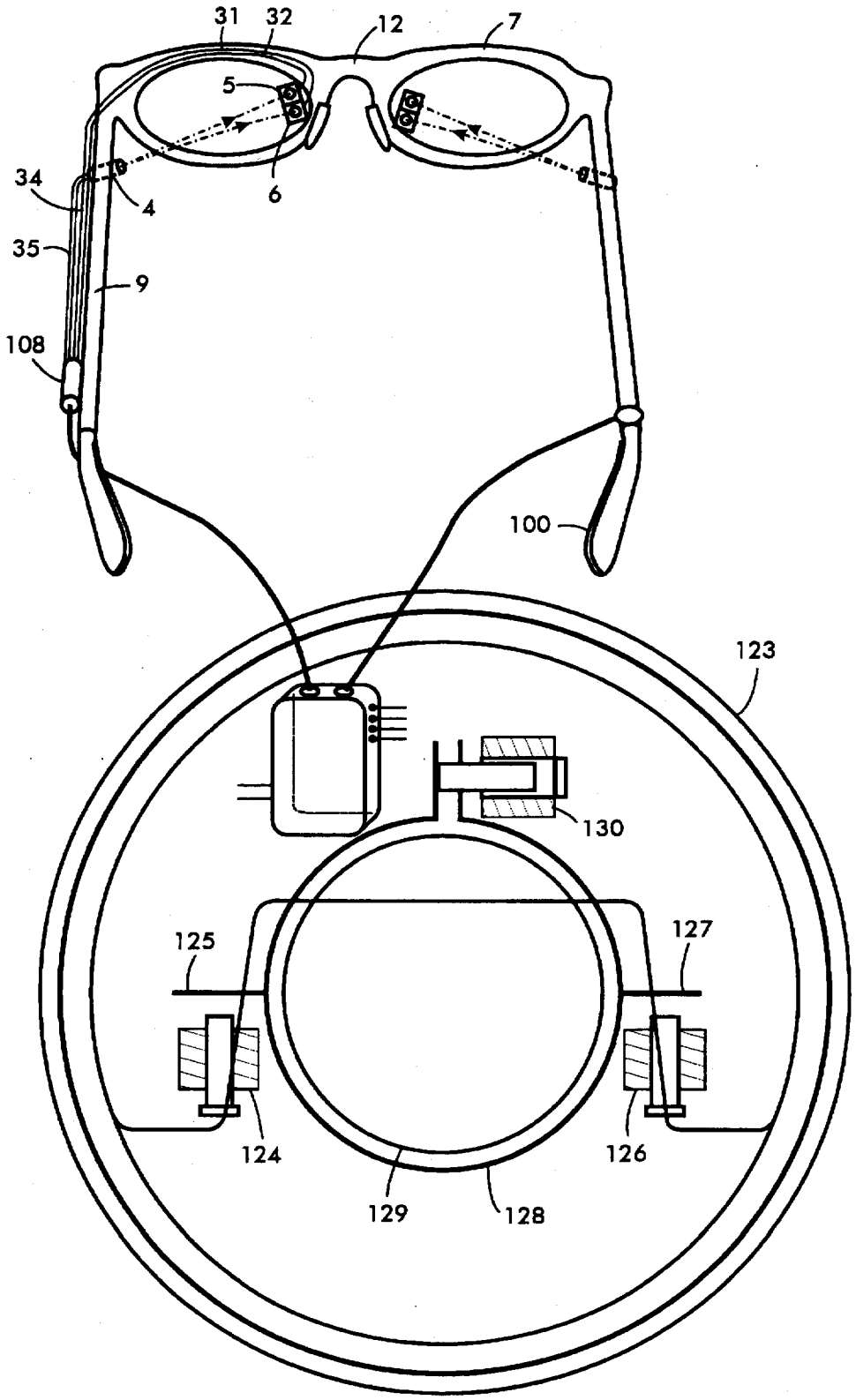
FIG. 31 shows the eyeglasses with an emitter and two infrared detectors for the left eye and also an emitter and two infrared detectors for the right eye mounted on the same eyeglasses according to the present invention. It also shows a typical steering wheel of an automobile, which steering wheel is controlled by means of solenoids, activated by means of blinking the the left or the right eye of the driver.

The present invention can be used also for controlling the movements of the steering wheel 123, FIG. 31 of an automobile by means of blinking either the right or the left eye.

Figure 32:
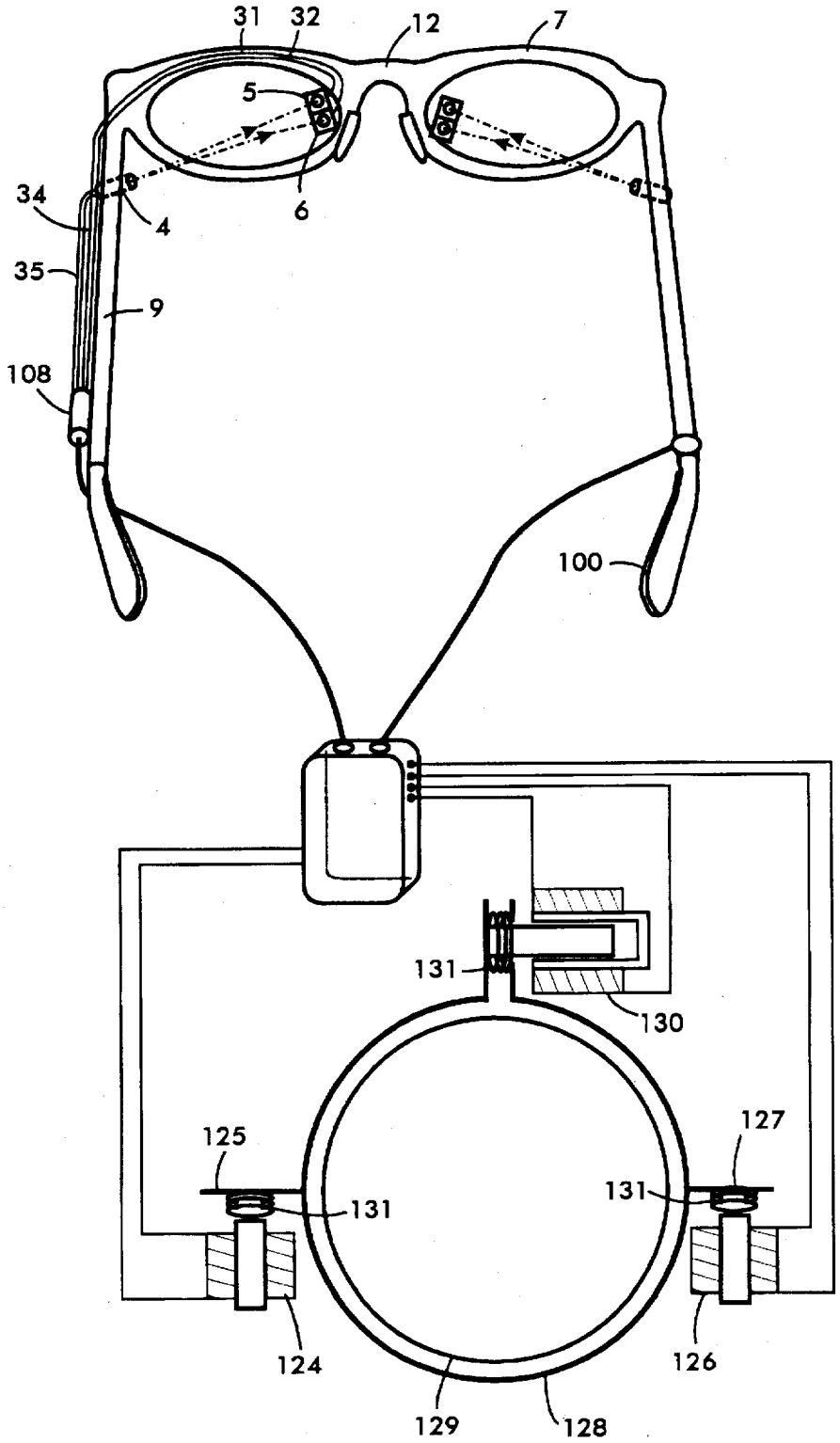
FIG. 32 shows the eyeglasses with an emitter and two infrared detectors for the left eye and also an emitter and two infrared detectors for the right eye according to the present invention.

For this purpose it has to be used a device, shown in FIGS. 31, 32 and 40, where the closing of the left eye is sensed by means of an emitter and two detectors, and where the eye closing signal is analyzed by means of electronic circuitry, shown in FIG. 8, with only this modification, that the buzzer is replaced with a relay, which connects a solenoid 124 to the 12 volts car battery. This solenoid is activated each time when the left eye of the driver is closed. This solenoid is arranged to turn the steering wheel counter clockwise each time when the left eye of the car driver is closed.

In this device it is also used a similar setup of sensors and activators for the right eye: the closing of the right eye is sensed by means of an emitter and two detectors, and the eye closing signal is analyzed by means of electronic circuitry, shown in FIG. 8, with only this modification, that the buzzer is replaced with a relay, which connects a solenoid 126 to the 12 volts car battery.

This solenoid is arranged to turn the steering wheel clockwise each time when the right eye of the car driver is closed.

When the driver blinks his or her left eye, the steering wheel 123, FIG. 31 is turned to the left by means of a strong solenoid 124, which pulls magnetically an iron member 125 of the cylindrical clamp 128 towards this solenoid, thus moving the steering wheel 123 counter clockwise.

When the driver blinks his or her right eye, the steering wheel 123, FIG. 31 is turned to the right by means of a strong solenoid 126, which pulls magnetically an iron member 127 of the cylindrical clamp 128 towards this solenoid, thus moving the steering wheel clockwise.

When the left or the right eye of the car driver is closing, the clamp 128 around the cylinder-forming widened section 129 of the steering wheel's shaft is by means of an solenoid 130, FIGS. 31, 32 and 40 clamped tight around this widened section 129, FIGS. 31, 32 and 40 of of the steering wheel's 123, FIGS. 31 and 40 shaft for the duration of the time when one of the driver's eyes is closed. This clamp is released immediately, when the driver opens his eye, thus returning the steering wheel back to its normal, manual steering mode.

For fast return of the soft iron members from their solenoid activated positions back to their normal positions, compressed springs 131, FIG. 32 are used. This fascilitates fast returning of the steering wheel back to its normal steering mode.

The right turn solenoid 126 and the left turn solenoid 124 are mounted rigidly on the car body, but the solenoid 130, which applies a clamp 128 around the steering wheel's widened section 129, is mounted flexibly, so that it can follow the steering wheels right or left turn movements when this clamp is on and either the solenoid 124 or the solenoid 126 is activated.

In FIG. 40 it is shown, how this device can be installed in a new car, between the steering rack and the steering wheel. Onto the lower part of the steering wheel's shaft can be attached permanently a cylindrical body 129, FIG. 40. Around this cylindrical body 129, FIG. 40 it is placed the clamp 128, FIG. 40 with a strong solenoid attached to it. This clamp has permanently attached to it on its right and left side two soft iron members 125 and 127, FIGS. 31, 32 and 40, which are pulled down either towards the solenoid 124 or towards the solenoid 126, when the car driver blinks his or her lift or right eye. These two solenoids 124 and 126 are rigidly mounted below the locations of these said soft iron members of the clamp. The clamp 128 and its solenoid are flexibly mounted under the dashboard. For safety reasons the steering wheel's turning movements to the right or to the left are limited time wise electronically to about only one second per each blink. Otherwise an automobile driver, who is holding the eye closed during several seconds, can inadvertedly overcorrect the intended change in the cars moving direction.

When the both eyes of the automobile driver are closed simultaneously for a longer time period than a second, then an audio alarm according to the present invention is arranged to sound.

Instead of wires connecting the eye-blinking signals from the eyeglasses to the steering wheel movements controlling solenoids; it can be used remote control by means of sound waves, ultrasound, infrared light or radiowaves.

In case the driver gets tired of blinking his or her eyes, as a back-up, the steering wheel's automatized movements movements can be controlled by means of two pushbuttons in convenient hand reach for the driver, for example on the front seat between the driver and the front seat passenger. One of these push-buttons, on the left side on this control box placed push-button is arranged to activate the solenoid, which is turning the steering wheel to the left, the other, on the right side on this control box placed push-button is arranged to activate the solenoid, which is turning the steering wheel to the right.

The present invention can be used also as a toy. For this application the present invention works in the following way: The electronic circuitry shown in FIG. 33 is the same as shown in FIG. 8, only the delay capacitor 25, FIG. 8 and the auxiliary battery 26, FIG. 8 are eliminated in order to generate a really sharp "peep" signal when the wearer of the eyeglasses according to the present invention closes and opens his or her eyes.

As a toy, this device has a novel surprise effect: only by blinking his or her eyes a person can generate a sequence of hilarious sound signals.

Colored light LED lamps, mounted on these eyeglasses and turned on concurrently with the generated sound, can make this toy still more interesting The same audible signal generator, shown in FIG. 33, can be used for activating various electric lights and various electric appliances.

The by the sound generator buzzer 18 generated audible signal is picked up by a microphone 132 FIG. 34. This microphone is connected to a battery 133 across a resistor 134. The signal from the microphone is amplified by means of an amplifier 135 and then passed through a filter circuitry 136 and a detector circuitry 137 into a pulse counter 138.

When the wearer of the eyeglasses blinks his or her eyes only once, this device will be turning on the living room lights 139, FIG. 34, when the wearer of the eyeglasses blinks twice, the TV will be turned on 140, FIG. 34. When the eyeglasses wearer blinks three times, the coffeepot will turned on 141, FIG. 34 and when the wearer blinks 4 times, the lights in kitchen will be turned on 142, FIG. 34. To turn off the corresponding appliances, the eyeglass-wearer has to generate longer sound "peeps" by closing his or her eyes for longer time periods.

Instead of a microphone, 132, FIG. 34 for pick-up of the eye-blinking signals, it can be used infrared remote control, similar to the control, which is used for television receivers, ultrasonics or radiowaves.

In FIG. 35 it is shown, how this eye movements analyzing device can be used for controlling the wheel chair's movements of a disabled person.

The disabled person can start his or her vehicle to drive forward 143, FIG. 35, by blinking once;

By blinking twice, he can make the vehicle to drive in the reverse direction, 144, FIG. 35;

By blinking three times the vehicle will turn to right, 145, FIG. 35;

By blinking four times the vehicle will turn to left, 146, FIG. 35

For eventual emergencies this disabled person can blink 5 times, 147, FIG. 35 or generate an extra long-lasting blink, to call for help or activate a telephone connection to 911.

These particular signals for controlling the movements of a wheelchair or similar vehicle and controlling the various actuators for electrical appliances are presented mainly for illustration purposes.

Many new kind of novel applications can be found for controlling various things in everyday life by means of closing and opening of the eyes according to the present invention, including the Morse code, which will enable a patient, who has speech disability and who can not talk, to have communication with his friends or medical personnel in a novel, easy way.

The people, who have narcolepsy, can have a device, alerting them with a loud sound, when they have fallen asleep suddenly.

Television channels on the home television can be changed, without lifting a finger. In this case, the audible alarm sound from this device, according to the invention, has to be changed understandably to quiet ultrasound, infrared light or radiowaves. Telefon answering machine can be turned on remotely, when a person is arriving home.

George Horace Gallup polls can be enchanced, by finding out how many viewers, people who are watching television, are falling asleep during TV programs under study. And how long they are sleeping.

Eyeglasses tend to slide down along the nose of many wearers of eyeglasses. The position of the infrared light beam from the infrared light emitter to the infrared light detector according to the present invention is very sensitive to sliding down of eyeglasses. The beam for analyzing the eyelid movements can move away from the optimum position, where it passes the eye in close proximity just above the eyeball.

To correct for this sliding down effect and achieve always the optimum beam positioning, multiple beams are used according the present invention as shown in FIG. 36. In this FIG. 36 are shown 6 infrared light detectors 5 mounted on a bracket, attached to the left temple 9, FIG. 36 of the eyeglasses 7, FIG. 36. In this FIG. 36 are shown the beams 11, FIG. 36, which are starting from two emitters 4, FIG. 36 and passing close to the eyeball 3, FIG. 36 on their way to infrared light detectors 5, FIG. 36.

In case the infrared light beam passes in close proximity the eyeball 3, FIG. 36 of the driver's eye, then the infrared light detector 5 of the electronic circuitry shown in FIG. 37 detects the eye-wetting blinkings of the eye. These eye-wetting blinkings of the human eye occur every 5 to 30 seconds and are quite involuntary. These eye-wetting blinkings are used in the present invention for establishing, that the infrared light-beam is passing in close proximity to the eyeball 3, FIG. 36, between the eyelids 1 and 2, FIG. 36. The output signal 148 from the infrared light detector 5 is going first through a differentiating circuitry 149, FIG. 37, consisting of a series capacitor 150, FIG. 37 followed by a resistor 151, FIG. 37 with other end grounded. In FIG. 38 it is shown the resulting pulse form of this signal at the output of this differentiating circuitry 149, FIG. 37.

These pulses are then going through a detector circuitry 152, consisting of a diode 153, FIG. 37 followed by a parallel coupled resistor 154, FIG. 37 and a capacitor 155, FIG. 37 with a time constant about one minute;

$$T=R\times C-1 \text{ minute}$$

The resulting pulse form of this signal at the output of this detector circuitry 152 is shown in FIG. 39. The output from this detector circuitry is connected to the base 156, FIG. 37 of the first transistor 157 in a Darlington circuitry 158, FIG. 37. The emitter 159 of this first transistor 157 is connected to the base 160, FIG. 37 of the second transistor 161 of this Darlington coupled circuitry 158, FIG. 37. The collectors of the both transistors are connected to a resistor 162, FIG. 37. This collector resistor 158, FIG. 37 of these two transistors will now carry current during that time, when there is a positive voltage output from the detector circuit 152, FIG. 37 and thus across this resistor 162, FIG. 37 is generated a certain voltage.

In case the driver's wakeup signal section of the FIG. 37 circuitry in Unit A has detected a longer than a second lasting closing of the eyes of the automobile driver, then a voltage will be generated across the collector resistor 163, FIG. 37.

Both voltages from resistors 162 and 163 will now be combined by means of diodes 164, FIG. 37 and 165, FIG. 37 in an AND circuitry 166, FIG. 37 and activate a PNP transistor 167, FIG. 37 which turns on the sleep preventing device's audio alarm buzzer 18, FIG. 37. This buzzer 18 is connected to the collector 168, FIG. 37 of transistor 167, FIG. 37.

The other units: Unit B, Unit C, Unit D, Unit E and Unit F are parallel coupled in similar way as Unit A, to the sleep preventing audio alarm buzzer 18, FIG. 37. In case the detectors of these other units, units B, C, D, E and F don't detect any eye-wetting signals, then they will not have any output current for the sleep preventing devices audio alarm buzzer.

But whenever they are detecting eye-wetting signals and simultaneously receiving in their drivers wake-up signal section, shown in FIG. 37 and also in FIG. 8, a longer than one second lasting closed eye signal, they are generating voltage to actuate the audio alarm buzzer 18, FIG. 37.

What is claimed is:

1. An eyeglasses attachable device for use by a person including a driver with emitting means for generating beams and with receiving detector means for receiving said emitting means generated beams, where the emitting means are sensing at least one beam across the eye just above the eyeball surface, but below the level of the surface of the eyelid in the direction of the beam receiving detector means, comprising:

(1) emitting means having a plurality of emitters for generating at least one beam;

(2) slide adjustable mounting means for mounting said emitting means on the temple of said eyeglasses, in such a way, that said beam traverses one of the driver's eyes just above the surface of the eye and between the upper and lower eyelids, while the driver's eyes are open;

(3) beam widening means, consisting of cylindrical or convex lenses in front of the emitter means and in front of the beam receiving detector means, which make the distance variations between the emitted beam and the eyeball less critical in terms of the operation sensitivity of the device, (4) electronically adjustable selecting means for selecting one of the plurality of emitters on the temple of said eyeglasses, in such a way that the selected beam traverses one of the driver's eyes just above the surface of the eye and between the upper and lower eyelids, while the driver's eyes are open;

(5) said beam receiving detecting means receiving a full beam when the driver's eyes are opened and receiving reduced, scattered beam parts when this driver's eyes are closed, for putting out electrical signals, characteristic of the received full beam and scattered beam;

(6) electronic alarm signal generating circuitry for receiving said electrical signals, and detecting input variations and converting said input variations into an alarm signal for alerting the driver, when the driver's eyes are closed;

(7) acoustic alarm generator, triggered by said alarm signal, by means of an electrical circuitry, for producing an audible alarm, for waking up the driver;

(8) a power source for powering the beam emitters, the beam receiving detector means, the selecting means, the alarm signal generating circuitry, the electronic circuitry and the acoustic alarm generator.

2. An eyeglasses attachable device according to claim 1, further comprising:

(1) ultrasonic transducers/transmitters as said emitters, each for generating an ultrasonic beam, and ultrasonic transducer/receiving detector means as said beam receiving detector means.

3. An eyeglasses attachable device, according to the claim 2, wherein the electronic circuitry comprises:

(1) an amplifier to amplify the from the ultrasonic transducer/receiver received ultrasonic beam signals;

(2) an RC filtering circuitry to filter out low frequency signals;

(3) a detector and RC circuitry for generating a delay before the onset of the audible alarm;

(4) two NPN transistors in a Darlington coupling;

(5) voltage divider consisting of two resistors for the emitter of the second transistor in the Darlington coupling;

(6) a buzzer as the acoustic alarm generator;

(7) wherein the output of the ultrasonic transducer/receiver is connected via an amplifier, the RC filter circuit and the diode/RC detector circuit to the base of the first NPN transistor; the voltage divider connected to the emitter of the second NPN transistor for generating approximately a one second time delay by said RC circuit before said buzzer sounds.

4. An eyeglasses attachable device according to claim 1, further comprising:

(1) infrared light emitters as said emitters, each for emitting an infrared beam, and infrared light receiving detector means as said beam receiving detector means;

(2) wherein said beam receiving detector means constitutes a first light detector means; and further comprising;

(3) second light detector means, consisting of a light detector mounted on the side of the first light detector on the eyeglasses, which second light detector is receiving full amount of said infrared light when the driver's eye is open and while at the same time the driver is looking downward, and reduced ambient scattered light, when the driver's eye is closed, for putting out said electrical signals;

(4) ambient light influence reducing means, consisting of a photocell for reducing the ambient light influence, which is incorporated into the electronic alarm signal generating circuitry as a negative light-resistance element by means of being coupled parallel with a resistor and in series with the infrared light receiving detector means between plus and minus leads of said power source;

(5) infrared light reflecting means in front of the eyeglasses and behind the temple of the eyeglasses in order to reduce the effect of bright sunshine during daytime driving;

(6) infrared filter means in front, back and on all the sides of individual light receiving detector means;

(7) said power supply source being one of: a battery mounted on the eyeglasses; a car battery connected permanently to the device; a car battery connected to the device via a plug-in connector into the cigarette light of a car; and solar cells mounted on the temple of the eyeglasses or on a headband of the driver.

5. An eyeglasses attachable device according to claim 4, wherein said photocell is a cadmium sulfide photocell.

6. An eyeglasses attachable device according to claim 4, wherein the electronic alarm circuitry comprises:

(1) an RC circuit for generating delay before the onset of the audible alarm;

(2) two NPN transistors in a Darlington coupling;

(3) a voltage divider consisting of two resistors, which resistors are used also as series resistors for the infrared light emitter, and which voltage divider is connected to the emitter of the second NPN transistor;

(4) a buzzer as the acoustic alarm generator;

(5) wherein the output of the first and second light detector means is connected via an integrating RC circuit to the base of the first NPN transistor for generating approximately a one second time delay by said RC circuit before said buzzer sounds.

7. An eyeglasses attachable device according to claim 4, wherein said power source consists of solar cells mounted on the temple of the eyeglasses and onto the headband, bridging the temples, and which solar cells are receiving infrared radiation from infrared light emitters and from incandescent lamps through infrared filters, mounted onto the ceiling of the car above the left shoulder and above the head of the car driver.

8. An eyeglasses attachable device for use with driver's eyeglasses according to claim 4, wherein the emitters are adjacently mounted and are sequentially activated to find an emitter having a relative position with the receiving detector means and eyeball that enables proper sensing operation of the device.

9. An eyeglasses attachable sleep preventing device for automobile drivers, with emitting means for generating of beams and with receiving means for these by emitting means generated beams, where the emitting means are sending at least one beam across the eye just above the eye surface, but below the level of the top surface of the eyelid in direction of the beam receiving means, according to claim 4, said device comprising:

(1) at least one infrared light emitter for emitting infrared light beams;

(2) multiple light detector means mounted on the temple of eyeglasses, which detectors are arranged to detect eye-wetting blinks, for putting out short electrical signals for these blinks, and which detectors are also arranged to detect longer duration eye closings, indicating the drowsiness of the car driver;

(3) electronic circuitry consisting of a series capacitor followed by a resistor, with its other terminal grounded, for differentiating these electrical signals generated by these short eye-wetting blinks, followed by an integrating detector circuitry, consisting of a diode, a capacitor and a resistor, with a very long, over a minute long time constant, which generates a positive voltage, so long the signals from eye-wetting blinks are received, where said positive voltage from the detector circuitry is amplified in an Darlington coupled transistor amplifier, thus generating a voltage in this transistor amplifier's load resistor, which voltage is combined with the voltage from driver wake-up signal circuitry's transistor amplifier's load resistor in an AND circuitry for generating an audio alarm signal, in case the drivers eyes are closed, and not generating any false alarm, in case the infrared light beam is hitting the skin of the face of the driver or it is passing the eye higher up above the eyelid level, thus no eye-wetting signals are detected, no voltage generated in said detector circuitry and thus no false alarm signal generated;

(4) electronic alarm signal generating circuitry, which generates an audible alarm, when the eye-wetting signals circuitry output is positive and simultaneously the driverwake-up signal section of the circuitry indicates that drivers eyes have been closed for one second or longer time.

10. An eyeglasses attachable sleep preventing device for automobile drivers, with emitting means for generating of beams and with receiving means for these by emitting means generated beams, where the emitting means are sending at least one beam across the eye just above the eye surface, but below the level of the top surface of the eyelid in direction of the beam receiving means, according to claim 4, said device comprising:

(1) a device, where the infrared light beam from one or several emitters is passing in close proximity to the eyeball of the driver and when interrupted by eye-wetting blinks, generates in a differentiating circuitry pulses with short time constant decaying time, these pulses are integrated in a very long time constant detector/integrator circuitry consisting of a diode, a capacitor and a resistor, the output of this detector circuitry is fed into a transistor amplifier, resistor of which is across a diode connected to an AND circuitry together with the output from the transistor load resistor of driverwake-up section of the circuitry across a diode, and which, when the driver wake up signal section indicates, that driver's eyes have been closed longer than one second, provides an audio alarm, and not giving any false alarm signal, in case the beam is hitting the skin of the face or the beam is passing the eye higher up above the eyelid, and no eye-wetting signals are detected and thus no false alarm is generated;

(2) where the infrared light from one or several emitters hits infrared light detectors of circuit Units A, B, C, D, E and F, and only these of the photodetectors contribute through the common transistor amplifier to the output alarm signal, which are sensing the presence of eye-wetting signals.

11. A device according to claim 4, wherein:

(1) said emitters are mounted onto the eyeglasses temple or onto an eyeglasses lens, close to the bridge of the eyeglasses, and wherein the receiving detector means comprises at least one light detector, mounted on the eyeglasses lens, close to the bridge of the eyeglasses, or onto the temple of the eyeglasses; said electronic circuitry and electronic alarm generating circuitry are mounted onto the driver-side visor of an automobile in a small container, and connected to the said emitters and detectors with a coiled four-wire cable;

(2) an eyeglass case, attached to said visor with a clamp or mounted onto it permanently;

(3) a two wire connection from the electronics mounted onto the visor, to the car battery, for powering this device;

(4) a two wire connection from said electronic circuitry mounted onto the visor, to the horn of the automobile, to generate a loud audible alertness signal for the driver;

(5) said horn being switched on by means of a relay which is inserted into the alarm generating circuitry.

12. An eyeglasses attachable device according to claim 4, wherein:

said emitters are using pulsed emitter light with pulse duration considerably shorter than the time interval between the pulses.

13. An eyeglasses attachable device according to claim 12, wherein:

the pulses for the emitters are generated by means of an integrated timer circuitry and wherein the receiving infrared light detector means is first connected to a differentiating filter circuitry and then connected to a detector circuitry consisting of a first resistor and a diode in series with a resistor, parallel coupled to the first resistor, and a capacitor connected to the power supply's positive terminal, and of two PNP transistors in a Darlington coupling, to activate the buzzer.

14. An eyeglasses attachable device for use with driver's eyeglasses according to claim 4, wherein the receiving detector means comprises a plurality of detectors that are adjacently mounted and are sequentially activated to enable finding an initial sensing positioning of the device on the driver for proper sensing operation of the device.

15. An eyeglasses attachable device for use with a pair of driver's eyeglasses according to claim 14, where the selection of the right infrared light beam to one of the infrared detectors mounted on the temple of the eyeglasses is done by means of electronically switching the beam from one infrared detector to the next infrared detector, until a beam is found, which is not blocked by the eyeball of the driver and which beam is subsequently used for driver's open eye/closed eye analyzis for the driver wake up alarm circuitry, and where this search for the best positioned beam it repeated at certain time intervals.

16. An eyeglasses attachable device according to claim 4, wherein the detector means comprising three detectors and adjustment of the position of the three infrared light detectors carrying on said mounting means is accomplished by means of a servomotor, which adjusts the position of a sliding block on the mounting means to select a detector having a relative position with the emitting emitter and eyeball that enables proper sensing operation of the device.

17. An eyeglasses attachable device for use with driver's eyeglasses according to claim 16, where the servomotor is activated by means of the electric motor control circuitry mounted onto the temple of the eyeglasses and connected to a gear reduction box, with a worm gear output shaft for moving the three infrared detectors carrying sliding block forth and back along the temple of the eyeglasses.

18. An eyeglasses attachable device for use with driver's eyeglasses according to claim 17, where the selection of the right infrared light beam from one of the emitters mounted on the temple of the eyeglasses to the infrared detector mounted close to the bridge of the eyeglasses is done by means of sequentially switching the beam from one emitter to the next emitter until the beam is found, which is not blocked by the eyeball of the driver and is subsequently used for driver's open eye/closed eye analyzis for the driver's wake up alarm circuitry, and where this search for the best positioned beam is repeated at certain time intervals.

* * * * *